US011468846B2

(12) United States Patent
Jang et al.

(10) Patent No.: US 11,468,846 B2
(45) Date of Patent: Oct. 11, 2022

(54) DISPLAY DEVICE

(71) Applicant: SAMSUNG DISPLAY CO., LTD., Yongin-si (KR)

(72) Inventors: Dae Gwang Jang, Yongin-si (KR); Hui Nam, Yongin-si (KR); Ha Neul Kim, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/141,640

(22) Filed: Jan. 5, 2021

(65) Prior Publication Data

US 2021/0366406 A1 Nov. 25, 2021

(30) Foreign Application Priority Data

May 22, 2020 (KR) ..... 10-2020-0061889

(51) Int. Cl.
*G09G 3/3275* (2016.01)
*G09G 3/3233* (2016.01)
*G09G 3/32* (2016.01)

(52) U.S. Cl.
CPC ..... *G09G 3/3275* (2013.01); *G09G 3/3233* (2013.01); *G09G 3/32* (2013.01); *G09G 2300/0426* (2013.01); *G09G 2300/0809* (2013.01); *G09G 2310/0291* (2013.01); *G09G 2310/08* (2013.01); *G09G 2320/029* (2013.01); *G09G 2320/045* (2013.01)

(58) Field of Classification Search
None
See application file for complete search history.

(56) References Cited

U.S. PATENT DOCUMENTS

| | | | | |
|---|---|---|---|---|
| 6,995,519 | B2 | 2/2006 | Arnold et al. | |
| 7,321,348 | B2 | 1/2008 | Cok et al. | |
| 10,504,391 | B2 | 12/2019 | Lim et al. | |
| 10,510,285 | B2 | 12/2019 | Kishi et al. | |
| 2018/0005581 | A1* | 1/2018 | Kim | G09G 3/3275 |
| 2020/0175923 | A1* | 6/2020 | Kim | G09G 3/3275 |
| 2021/0150981 | A1* | 5/2021 | Lee | G09G 3/3233 |

FOREIGN PATENT DOCUMENTS

KR 1020180049370 A 5/2018

* cited by examiner

*Primary Examiner* — Christopher J Kohlman
(74) *Attorney, Agent, or Firm* — Cantor Colburn LLP

(57) ABSTRACT

A display device includes: a pixel unit including a pixel connected to a data line; a data driver which supplies a sensing reference voltage to the data line during a sensing period, and supplies a data signal to the data line during a display period; and a sensing unit which receives a sensing current corresponding to the sensing reference voltage during the sensing period, and generates correction data based on the supplied sensing current. The sensing unit includes a current integrator which outputs a sensing voltage based on the sensing current input thereto through a first input terminal and based on the sensing reference voltage input thereto through a second input terminal.

22 Claims, 16 Drawing Sheets

DISPLAY DEVICE

This application claims priority to Korean Patent Application No. 10-2020-0061889, filed on May 22, 2020, and all the benefits accruing therefrom under 35 U.S.C. § 119, the content of which in its entirety is herein incorporated by reference.

BACKGROUND

1. Field

The disclosure generally relates to a display device.

2. Description of the Related Art

With the development of information technologies, the importance of a display device, which is a connection medium between a user and information, increases. Accordingly, display devices such as a liquid crystal display device and an organic light emitting display device are increasingly used.

Among the display devices, an organic light emitting display device displays an image using an organic light emitting diode that generates light by recombination of electrons and holes. The organic light emitting display device has a high response speed and is driven with low power consumption.

The organic light emitting display device may include pixels connected to data lines and scan lines. Each of the pixels generally includes an organic light emitting diode and a driving transistor for controlling an amount of current flowing through the organic light emitting diode. The pixel generates light with a predetermined luminance, corresponding to a data signal, while supplying current to the organic light emitting diode from the driving transistor.

SUMMARY

In an organic light emitting display device, each of pixels including a light emitting diode may be degraded. For example, the light emitting diode in a pixel may be degraded, or the threshold voltage and mobility of the driving to transistor may be changed over time. Accordingly, a technique for sensing characteristic information of the pixels (i.e., the driving transistor and the light emitting diode) through an external sensing circuit may be used to compensate for degradation of the pixels.

In sensing characteristic information of a pixel, a pixel unit may be applied with a data signal from a data driver. A sensing unit may receive a current corresponding to the data signal from the pixel unit, and output a sensing voltage corresponding to the current.

However, when a voltage of the applied data signal and a sensing reference voltage applied to the sensing unit are different from each other, a capacitor coupling phenomenon may occur in the pixel unit. Therefore, the sensing unit may output a sensing voltage which does not correspond to the applied data signal.

Embodiments provide a display device in an accurate sensing voltage corresponding to a data signal is generated for sensing.

In accordance with an embodiment of the disclosure, a display device includes: a pixel unit including a pixel connected to a data line; a data driver which supplies a sensing reference voltage to the data line during a sensing period, and supplies a data signal to the data line during a display period; and a sensing unit which receives a sensing current corresponding to the sensing reference voltage during the sensing period, and generate correction data based on the supplied sensing current. In such an embodiment, the sensing unit includes a current integrator which outputs a sensing voltage based on the sensing current input thereto through a first input terminal and based on the sensing reference voltage input thereto through a second input terminal.

In an embodiment, the current integrator may include: a current integrator amplifier including the first input terminal and the second input terminal; and an integrator capacitor including one end connected to the first input terminal and another end connected to an output terminal of the current integrator amplifier.

In an embodiment, the sensing unit may further include an initialization switch including one end connected to the first input terminal and another end connected to the output terminal of the current integrator amplifier.

In an embodiment, the data driver may include a buffer including buffer amplifiers which supply the sensing reference voltage or the data signal to data output lines.

In an embodiment, the second input terminal of the current integrator amplifier may be connected to an a-th node connected to an output terminal of the buffer through a connection line.

In an embodiment, a b-th node connected to the data line may be connected between the a-th node and the first input terminal of the current integrator amplifier. In such an embodiment, the sensing unit may further include a first switch connected between the a-th node and the b-th node, and a second switch connected between the b-th node and the first input terminal of the current integrator amplifier.

In an embodiment, the first switch may be turned on while the sensing to reference voltage is being supplied to the pixel, and the second switch may be turned on while the sensing current is being supplied to the sensing unit.

In an embodiment, the connection line may further include a third switch connected between the a-th node and the second input terminal of the current integrator amplifier, and the third switch may be turned on while the sensing current is being supplied to the sensing unit.

In an embodiment, the connection line may further include a reference voltage storage capacitor connected between the a-th node and a ground terminal.

In an embodiment, the sensing unit may further include: a fourth switch including one end connected to the a-th node and another end connected to the ground terminal; and a fifth switch connected between one end of the reference voltage storage capacitor, which is connected to the a-th node, and the second input terminal of the current integrator amplifier.

In an embodiment, the fourth switch may be turned on in a certain period before the data signal is supplied to the pixel, and the fifth switch may be turned on while the sensing current is being supplied to the sensing unit.

In an embodiment, the sensing unit may further include a sixth switch connected between the at-h node and the one end of the reference voltage storage capacitor, which is connected to the connection line.

In an embodiment, the sixth switch may be turned on while the data signal is being supplied to the pixel.

In an embodiment, the sensing unit may generate compensation data including degradation information of the pixel, based on the sensing voltage.

In an embodiment, the display device may further include a timing controller configured to receive first image data from the outside, and supply, to the data driver, second image data obtained by adding up the first image data and the compensation data.

In an embodiment, the sensing unit may further include an analog-digital converter connected between an output terminal of a current integrator amplifier of the current integrator and the timing controller, where the analog-digital converter may convert the sensing voltage from an analog form to a digital form.

In an embodiment, the pixel may be connected to a first scan line, a second scan line, and an emission control line. In such an embodiment, the pixel may include: a light emitting diode connected to a second power source; a first transistor including a first electrode connected to a first node electrically connected to a first power source, a second electrode connected to a second node, and a gate electrode connected to a third node; a second transistor connected between the data line and the second node, where a gate electrode of the second transistor may be connected to the first scan line; and a third transistor connected between the third node and a third power source, where a gate electrode of the third transistor may be connected to the second scan line.

In an embodiment, the pixel may further include a fourth transistor connected between the first power source and the first node, where a gate electrode of the fourth transistor may be connected to the emission control line.

In an embodiment, the pixel may further include a storage capacitor connected between the second node and the third node.

In an embodiment, the second transistor and the third transistor may be turned on while the sensing reference voltage or the data signal is being supplied to the pixel.

In an embodiment, the second transistor and the fourth transistor may be turned on while the sensing current is being supplied to the sensing unit.

BRIEF DESCRIPTION OF THE DRAWINGS

The above and other features of the invention will become more apparent by describing in further detail embodiments thereof with reference to the accompanying drawings, in which.

DETAILED DESCRIPTION

Figure 1:
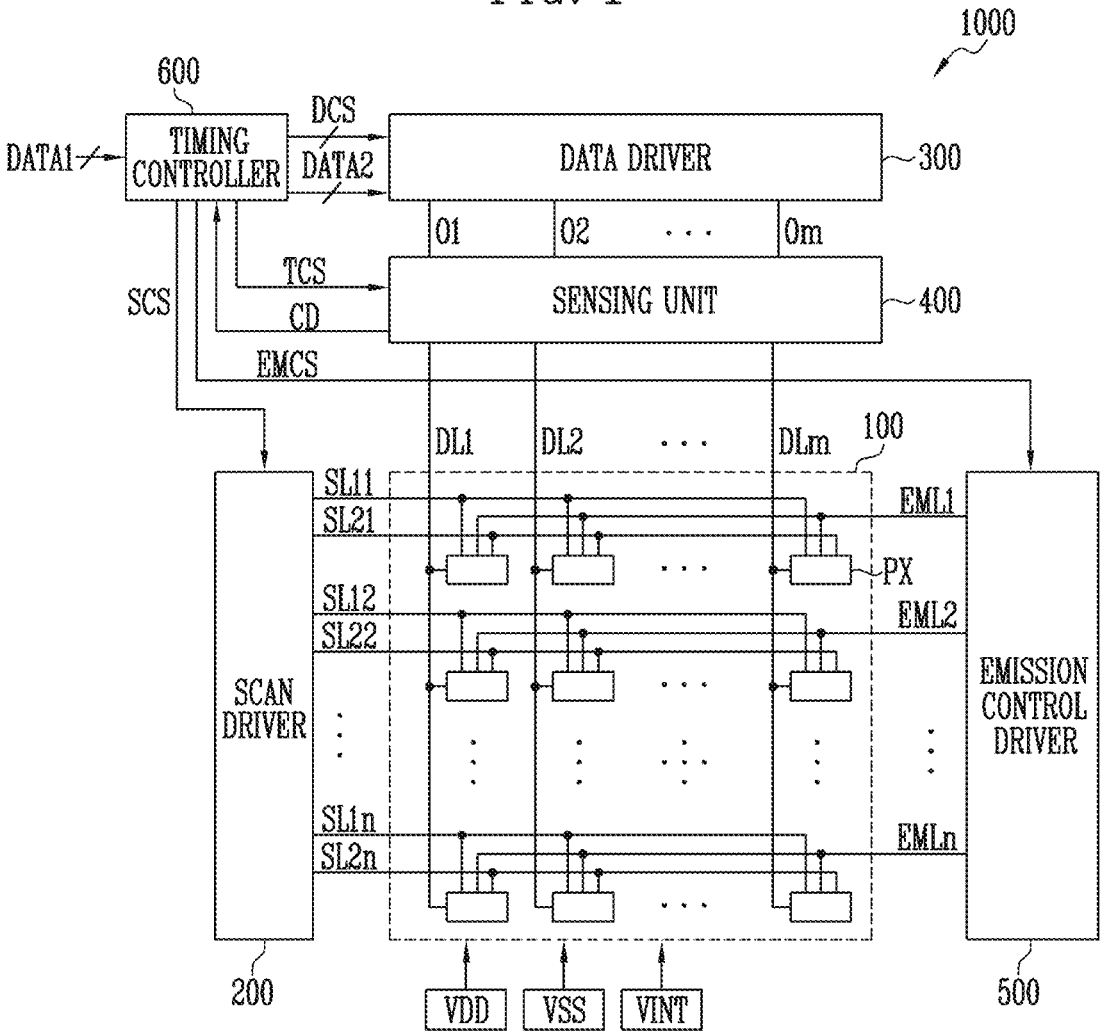
FIG. 1 is a block diagram illustrating a display device in accordance with an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "or" means "and/or." As used herein, the term "and/or" includes any and all combinations of one or more of the associated listed items.

It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the disclosure will be described in detail with reference to the accompanying drawings.

FIG. 1 is a block diagram illustrating a display device in accordance with embodiments of the disclosure.

Referring to FIG. 1, an embodiment of the display device 1000 may include a pixel unit 100, a scan driver 200, a data driver 300, a sensing unit 400, an emission control driver 500, and a timing controller 600.

The display device 1000 may be a flat panel display device, a flexible display device, a curved display device, a foldable display device, or a bendable display device. In an embodiment, the display device 1000 may be a transparent display device, a head-mounted display device, a wearable display device, or the like. In an embodiment, the display device 1000 may be applied to various electronic devices such as a smartphone, a tablet personal computer ("PC"), a smart pad, a television ("TV"), and a monitor.

In an embodiment, the display device 1000 may be implemented as an organic light emitting display device, a liquid crystal display device, or the like. However, there are merely exemplary, and the configuration of the display device 1000 is not limited thereto. In one embodiment, for example, the display device 1000 may be a self-luminescent display device including an inorganic light emitting diode.

In an embodiment, the display device 1000 may be driven in a display period for displaying an image and a sensing period for sensing a characteristic of a driving transistor included in each of pixels PX.

The pixel unit 100 includes pixels PX connected to data lines DL1 to DLm (m is a natural number), first scan lines SL11 to SL1*n* (n is a natural number), second scan lines SL21 to SL2*n*, and emission control lines EML1 to EMLn. The pixels PX may be supplied with voltages of a first power source VDD, a second power source VSS, and a third power source (or initialization power source) VINT from an outside. In an embodiment, the first power source VDD may determine a voltage (e.g., a drain voltage) of a first electrode of the driving transistor, and the second power source VSS may determine a cathode voltage of a light emitting diode.

FIG. 1 shows an embodiment where n first and second scan lines SL11 to SL1*n* and SL21 to SL2*n* and *n* emission control lines EML1 to EMLn are included, but the disclosure is not limited thereto. In an embodiment, the number of the scan lines, the number of the emission control lines, or the like may be variously modified based on a circuit structure of the pixel PX.

The timing controller 600 may generate a data driving control signal DCS and a scan driving control signal SCS, based on synchronization signals supplied from an outside. The data driving control signal DCS generated by the timing controller 600 may be supplied to the data driver 300, and the scan driving control signal SCS generated by the timing controller 600 may be supplied to the scan driver 200.

In an embodiment, the timing controller 600 may supply second image data DATA2, generated by compensating first image data DATA1, to the data driver 300. The first image data DATA1 and the compensated second image data DATA2 may include grayscale information included in a grayscale range set in the display device.

A source start signal and clock signals may be included in the data driving control signal. The source start signal may control a sampling start time of data. The clock signals may control a sampling operation.

A scan start signal, a control start signal and clock signals may be included in the scan driving control signal SCS. The scan start signal may control a timing of a scan signal. The control start signal may control a timing of a control signal. The scan start signal and/or the control start signal may be shifted based on the clock signals.

The timing controller 600 may control an operation of the sensing unit 400 through a sensing control signal TCS. In one embodiment, for example, the timing controller 600 may control a timing at which a data signal for sensing is supplied to the pixels PX through the data lines DL1 to DLn and a timing at which a current generated in the pixel PX is sensed through the data lines DL1 to DLn.

The scan driver 200 may receive the scan driving control signal SCS from the timing controller 600. The scan driver 200 receiving the scan driving control signal SCS may supply first and second scan signals to the first and second scan lines SL11 to SL1*n* and SL21 to SL2*n*.

In an embodiment, the scan driver 200 may sequentially supply a scan signal to the first and second scan lines SL11 to SL1*n* and SL21 to SL2*n*. When the scan signal is sequentially supplied to the first and second scan lines SL11 to SL1*n* and SL21 to SL2*n*, pixels PX may be selected in a unit of a horizontal line. In an embodiment, the first and second scan signals may be set to have a gate-on voltage (e.g., a logic high level) at which transistors included in the pixels PX are turned on.

The emission control driver 500 may sequentially supply an emission control signal to the pixels PX through the emission control lines EML1 to EMLn, based on an emission driving control signal EMCS. The emission control driver 500 receives the emission driving control signal EMCS, a clock signal, and the like from the timing controller 600. The emission control signal may divide one frame period into an emission period and a non-emission period with respect to pixels located in a same horizontal line (a same pixel row).

In an embodiment, a single scan driver 200 outputs both the first scan signal and the second scan signal, as illustrated in FIG. 1, but the disclosure is not limited thereto. In one alternative embodiment, for example, the scan driver 200 may include a first scan driver which supplies the first scan signal to the pixel unit 100 and a second scan driver which supplies the second scan signal to the pixel unit 100.

The data driver 300 may be supplied with the data driving control signal DCS from the timing controller 600. During the sensing period, the data driver 300 may supply a data signal for pixel characteristic detection to the pixel unit 100. During the display period, the data driver 300 may supply a data signal for image display to the pixel unit 100, based on the compensated second image data DATA2.

The sensing unit 400 may be connected between the data driver 300 and the pixel unit 100. The sensing unit 400 connects data output lines O1 to Om and the data lines DL1 to DLm to each other. During the sensing period, the sensing unit 400 may sense degradation information of a light emitting diode included in each of the pixels PX and/or threshold voltage/mobility information of the driving transistor included in each of the pixels PX. The sensing unit 400 may store compensation data CD including the degradation information of the light emitting diode and the threshold voltage/mobility information of the driving transistor, and supply the stored compensation data CD to the timing controller 600.

In an embodiment, the sensing unit 400 may include an analog-digital converter 420 (see FIG. 4) which converts a sensing value supplied through the data lines DL1 to DLm into a current code in a digital form.

In an embodiment, the sensing unit 400 may be a component separate from or disposed outside the timing controller 600 as illustrated in FIG. 1, but not being limited thereto. Alternatively, at least a portion of the sensing unit 400 may be included in the timing controller. In one embodiment, for example, the sensing unit 400 and the timing controller 600 may be formed as a single driving integrated circuit ("IC"). In an embodiment, the data driver 300 may also be included in the timing controller 600. Therefore, at least some of the sensing unit 400, the data driver 300, and the timing controller 600 may be formed as a single driving IC.

Figure 2A:
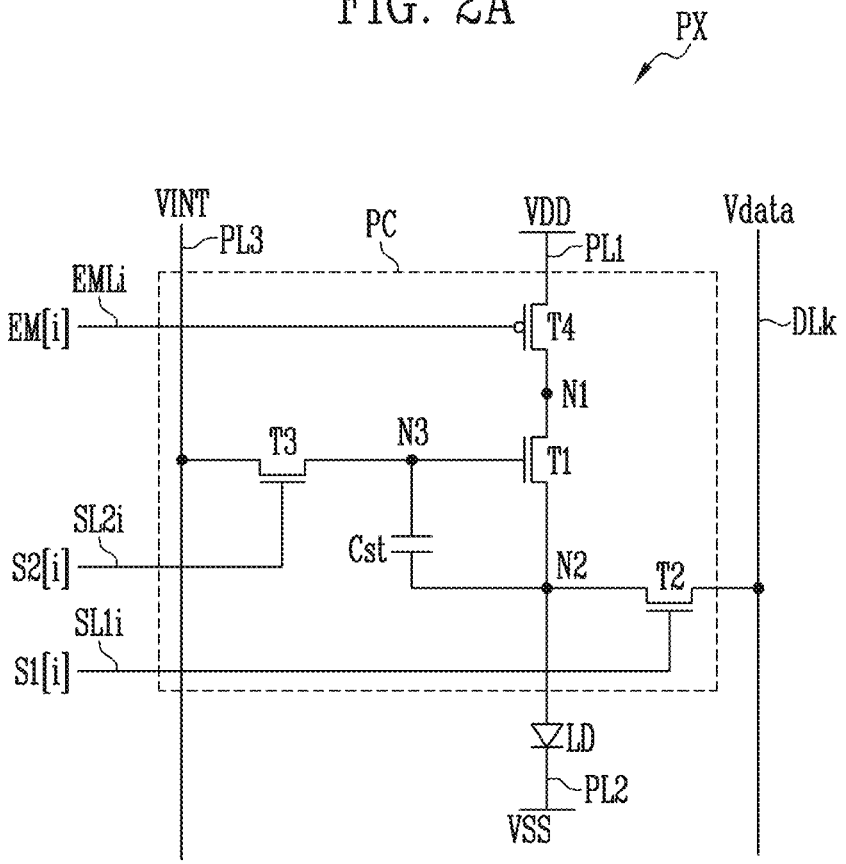
FIGS. 2A and 2B are circuit diagrams illustrating embodiments of a pixel included in the display device shown in FIG. 1.
Figure 2B:
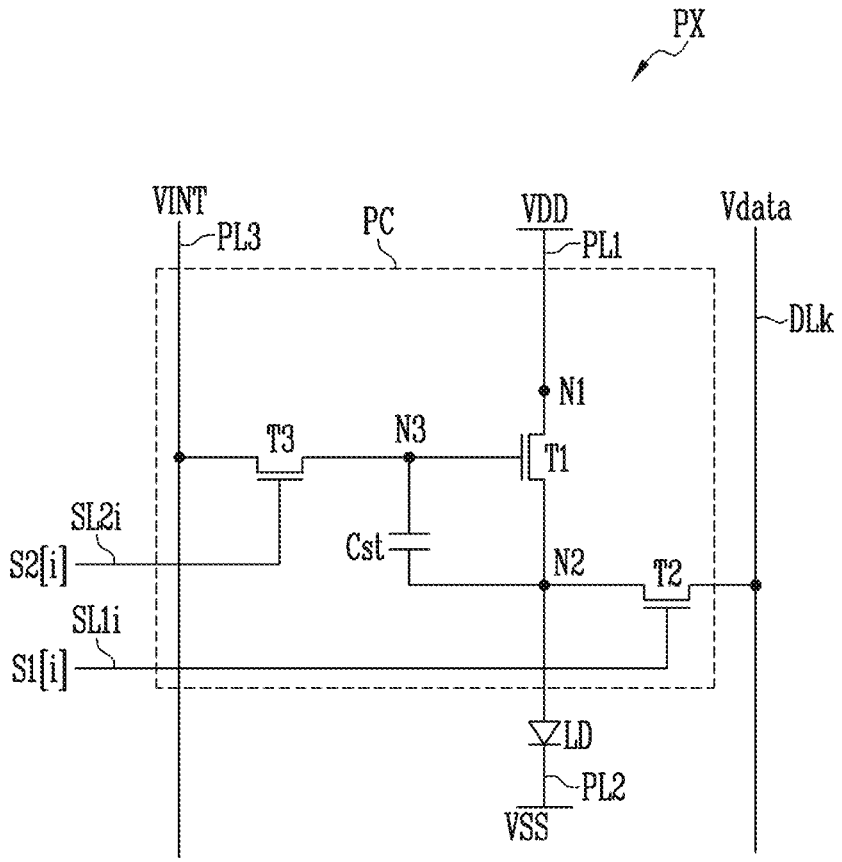

FIGS. 2A and 2B are circuit diagrams illustrating embodiments of the pixel included in the display device shown in FIG. 1.

Referring to FIGS. 1 and 2A, an embodiment of a pixel PX may include a light emitting diode LD and a pixel circuit PC connected to the light emitting diode LD.

The pixel PX shown in FIG. 2A is a pixel disposed in an i-th row and a k-th column (i and k are natural numbers), which is connected to an i-th first scan signal line SL1*i*, an i-th second scan signal line SL2*i*, an i-th emission control line EMLi, and an k-th data line DLk.

An anode of the light emitting diode LD may be connected to the pixel circuit PX, and a cathode of the light emitting diode LD may be connected to the second power source VSS. The light emitting diode LD may generate light with a predetermined luminance corresponding to an amount of current supplied from the pixel circuit PX.

The light emitting diode LD may be configured as an organic light emitting diode or an inorganic light emitting diode such as a micro light emitting diode ("LED") or a quantum dot light emitting diode. In an embodiment, the light emitting diode LD may be a light emitting diode including or made of a combination of an organic material and an inorganic material. In an embodiment, as shown in FIGS. 2A and 2B, the pixel PX may include a single light emitting diode LD, but not being limited thereto. In an alternative embodiment, each pixel PX may include a plurality of light emitting diodes, and the plurality of light emitting diodes may be connected in parallel to each other or be connected in series to each other.

The pixel circuit PC controls an amount of current flowing from the first power source VDD to the second power source VSS via the light emitting diode LD, based on a data signal Vdata. In such an embodiment, the first power source VDD may be set to a voltage higher than that of the second power source VSS.

In an embodiment, as shown in FIG. 2A, the pixel circuit PC may include first to fourth transistors T1 to T4 and a storage capacitor Cst.

In such an embodiment, the first transistor T1 may be connected between a first node N1 electrically connected to the first power source (or a first power line PL1 and a second node N2 electrically connected to the anode of the light emitting diode LD. A gate electrode of the first transistor T1 may be connected to a third node N3. The first transistor T1 may provide the light emitting diode LD with a driving current corresponding to a voltage of the third node N3. The first transistor T1 serves as a driving transistor of the pixel PX.

The second transistor T2 may be connected between a kth data line DLk and the second node N2. The second transistor T2 may include a gate electrode which receives a first scan signal S1[*i*]. When the second transistor T2 is turned on, the data signal Vdata may be transferred to the second node N2.

The third transistor T3 may be connected between the third node N3 and the third power source VINT (or a third power line PL3). The third transistor T3 may include a gate electrode which receives a second scan signal S2[*i*]. The third transistor T3 may be turned on when the second scan signal S2[*i*] is supplied, to supply a voltage of the third power source VINT to the third node N3.

The fourth transistor T4 may be connected between the first power source VDD and the first node N1. The fourth transistor T4 may include a gate electrode receiving an emission control signal EM[i]. The fourth transistor T4 may be turned on in a gate-on period of the emission control signal EM[k], and be turned off in a gate-off period of the emission control signal EM[k].

The light emitting diode LD may be connected between the second node N2 and the second power source VSS (or a second power line PL2). The cathode of the light emitting diode LD may be applied with the second power source VSS. The first power source VDD and the second power source VSS may have different potentials. In an embodiment, the first power source VDD may be set as a high-potential power source, and the second power source VSS may be set as a low-potential power source. A potential difference between the first and second power sources VDD and VSS may be set to be equal to or greater than a threshold voltage of the light emitting diode LD during an emission period of the pixel PX. In an embodiment, as shown in FIG. 2A, the first to third transistors T1, T2, and T3 included in the pixel PX may be implemented with an N-type transistor, and the fourth transistor T4 may be implemented with a P-type transistor. However, the disclosure is not limited thereto.

In embodiments of the invention, the pixel circuit PC is not limited to the structure shown in FIG. 2A. In one alternative embodiment, for example, as shown in FIG. 2B, a pixel circuit PC may be configured with first to third transistors T1 to T3 and a storage capacitor Cst. In an embodiment of the pixel circuit PC shown in FIG. 2B, a configuration or an operation of the first to third transistors T1, T2, and T3 and the storage capacitor Cst is similar to that of the pixel circuit PC shown in FIG. 2A, except that the fourth transistor T4 for controlling an emission time of the light emitting diode LD is omitted. Therefore, any repetitive detailed description of the same or like elements will be omitted.

Figure 3:
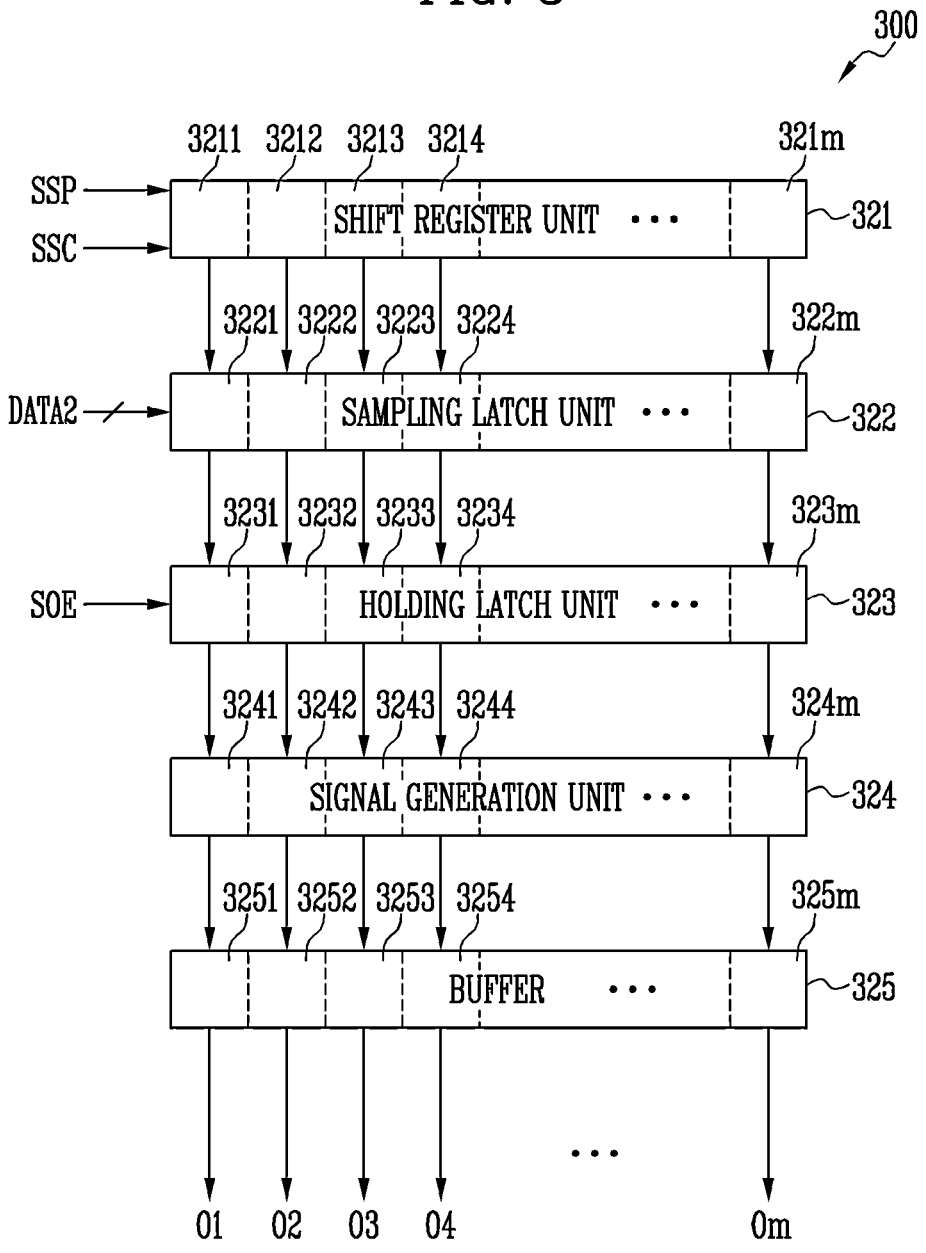
FIG. 3 is a diagram illustrating an embodiment of a data driver shown in FIG. 1.

FIG. 3 is a diagram illustrating an embodiment of the data driver shown in FIG. 1.

Referring to FIG. 3, an embodiment of the data driver 300 may include a shift register unit 321, a sampling latch unit 322, a holding latch unit 323, a signal generation unit 324, and a buffer 325.

The shift register unit 321 may sequentially generate m (m is a natural number greater than 0) sampling signals in response to a source start pulse SSP and a source shift clock SSC, which are output from the timing controller 600. In an embodiment, the shift register unit 321 may sequentially output the m sampling signals while shifting the source start pulse SSP for every one period of the source shift clock SSC. The shift register unit 321 may include or be implemented with m shift registers 3211 to 321*m*.

The sampling latch unit 322 may sequentially store second data DATA2 in response to the sampling signals sequentially supplied from the shift register unit 321. The sampling latch unit 322 may include or be implemented with m sampling latches 3221 to 322*m* for storing m second data DATA2.

The holding latch unit 323 may store the second data DATA2 supplied from the sampling latch unit 322 in response to a source output enable signal SOE output from the timing controller 600. The holding latch unit 323 may supply the second data DATA2 stored therein to the signal generation unit 324. The holding latch unit 323 may include or be implemented with m holding latches 3231 to 323*m*.

The signal generation unit 324 may converts the second data DATA2 output from the holding latch unit 323 into an analog signal, and output the converted analog signal as a data signal to the buffer 325. The signal generation unit 324 may include or be implemented with m digital-analog converters 3241 to 324*m*. In such an embodiment, the signal generation unit 324 may generate m data signals based on the digital-analog converters 3241 to 324*m* respectively disposed in channels, and supply the generated data signals to the buffer 325.

The buffer 325 may supply the m data signals supplied from the signal generation unit 324 to m data output lines O1 to Om, respectively. The buffer 325 may include or be implemented with m buffer amplifiers 3251 to 325*m*.

Figure 4:
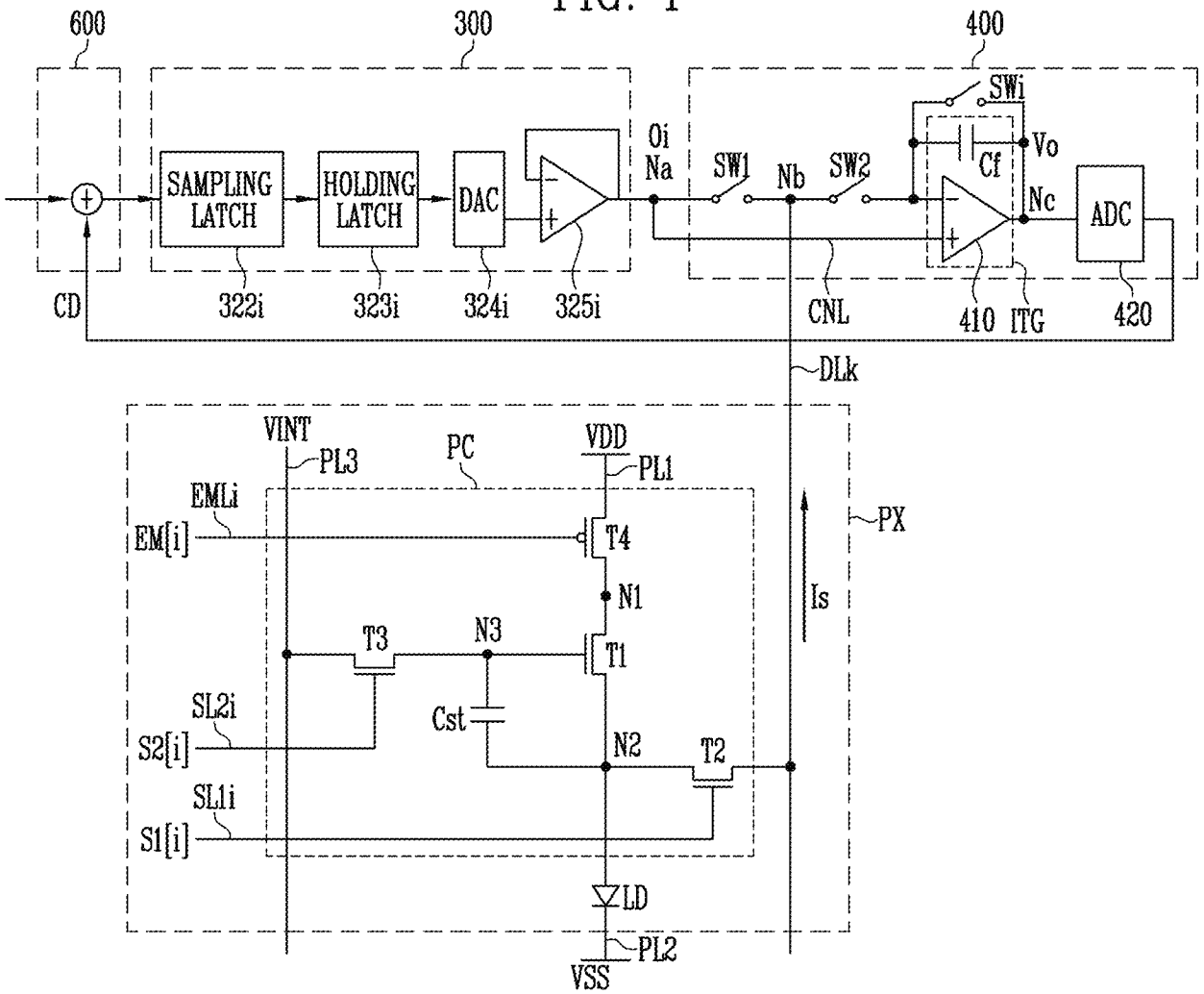
FIG. 4 is a diagram illustrating a connection structure of a timing controller, the data driver, a sensing unit, and the pixel, which are shown in FIG. 1, in accordance with an embodiment of the disclosure.

FIG. 4 is a diagram illustrating a connection structure of the timing controller, the data driver, the sensing unit, and the pixel, which are shown in FIG. 1, in accordance with an embodiment of the disclosure.

For convenience of illustration and description, the timing controller 600 and the data driver 300 are schematically illustrated in FIG. 4. Also, for convenience of illustration and description, a connection structure of one pixel PX is illustrated in FIG. 4.

Referring to FIGS. 1, 3 and 4, in an embodiment, the timing controller 600 may generate second data DATA2 by converting first data DATA1 supplied from an outside in response to compensation data CD supplied from the sensing unit 400, and output the generated second data DATA2 to the data driver 300.

The data driver 300 may convert the second data DATA2 output from the timing controller 600 into an analog signal, and supply the converted analog signal as a data signal to a data output line Oi.

In an embodiment, a sampling latch 322*i* may latch data corresponding to an i-th channel among the second data DATA2 output from the timing controller 600, and output the latched data to a holding latch 323*i*.

The holding latch 323*i* may latch the data output from the sampling latch 322*i* in response to the source output enable signal SOE, and output the latched data to a digital-analog converter 324*i*.

The digital-analog converter 324*i* may convert the second data DATA2 output from the holding latch 323*i* into an analog signal, and output the converted analog signal to a buffer amplifier 325*i*.

The buffer amplifier 325*i* may supply the analog signal output from the digital-analog converter 324*i* as a data signal to the data output line Oi. A first input terminal of the buffer amplifier 325*i* may be connected to an a-th node Na, i.e., the data line DLk, a second input terminal of the buffer amplifier 325*i* may be connected to the digital-analog converter 324*i*, and an output terminal of the buffer amplifier 325*i* may be connected to the a-th node Na, i.e., the data output line Oi of the data driver 300.

The sensing unit may include a first switch SW1, a second switch SW2, a current integrator ITG, an initialization switch SWi, and the analog-digital converter ("ADC") 420.

The first switch SW1 may be connected between the a-th node Na and a b-th node Nb. The a-th node Na may be the output terminal of the buffer amplifier 325*i*, and the b-th node Nb may be a node connected to the data line DLk. In such an embodiment, the first switch SW1 may be connected between the data output line Oi and the data line DLk. The first switch SW1 may be turned on in response to a corresponding switching control signal output from the timing controller 600.

The second switch SW2 may be connected between the b-th node Nb and a first input terminal of a current integrator amplifier 410. In such an embodiment, the second switch SW2 may be connected between the data line DLk and the first input terminal of the current integrator amplifier 410. The second switch SW2 may be turned on in response to a corresponding switching control signal output from the timing controller 600.

In accordance with an embodiment, the current integrator ITG may be connected between the b-th node NB and a c-th node Nc, i.e., an input terminal of the ADC 420.

The current integrator ITG may have a first input terminal for receiving a sensing current Is of the pixel PX, which corresponds to the data signal, through the data line DLk, and output a sensing voltage corresponding to the sensing current Is. The current integrator ITG may have a second input terminal for receiving a sensing reference voltage, and sense a current characteristic of the pixel PX, based on the sensing reference voltage. The second input terminal may be connected directly to the a-th node Na through a connection line CNL. The sensing reference voltage will be described in greater detail later with reference to FIGS. 5 to 7.

In an embodiment, the current integrator ITG may include the current integrator amplifier 410 and an integrator capacitor Cf. One end of the integrator capacitor Cf may be connected to the first input terminal (e.g., an inverting input terminal) of the current integrator amplifier 410, and another end of the integrator capacitor Cf may be connected to an output terminal (i.e., the c-th node Nc) of the current integrator amplifier 410.

In an embodiment, the current integrator ITG may further include the initialization switch SWi including one end connected to the first input terminal of the current integrator amplifier 410 and another end connected to the output terminal of the current integrator amplifier 410. The integrator capacitor Cf may be initialized by turning on the initialization switch SWi when sensing is completed.

The ADC 420 may be connected between the c-th node Nc and an input terminal of the timing controller 600. The input terminal of the ADC 420 may be connected to the c-th node Nc. A node voltage of the c-th node Nc, i.e., an output voltage Vo of the current integrator amplifier 410, may be applied to the ADC 420.

The ADC 420 may convert a voltage (i.e., the output voltage Vo of the current integrator amplifier 410) provided to the input terminal (i.e., the c-th node Nc) into a digital code. In such an embodiment, the sensing unit 400 may convert the output voltage Vo of the current integrator amplifier 410 into a digital code, and supply the converted digital code as compensation data CD to the timing controller 600.

Figure 5:
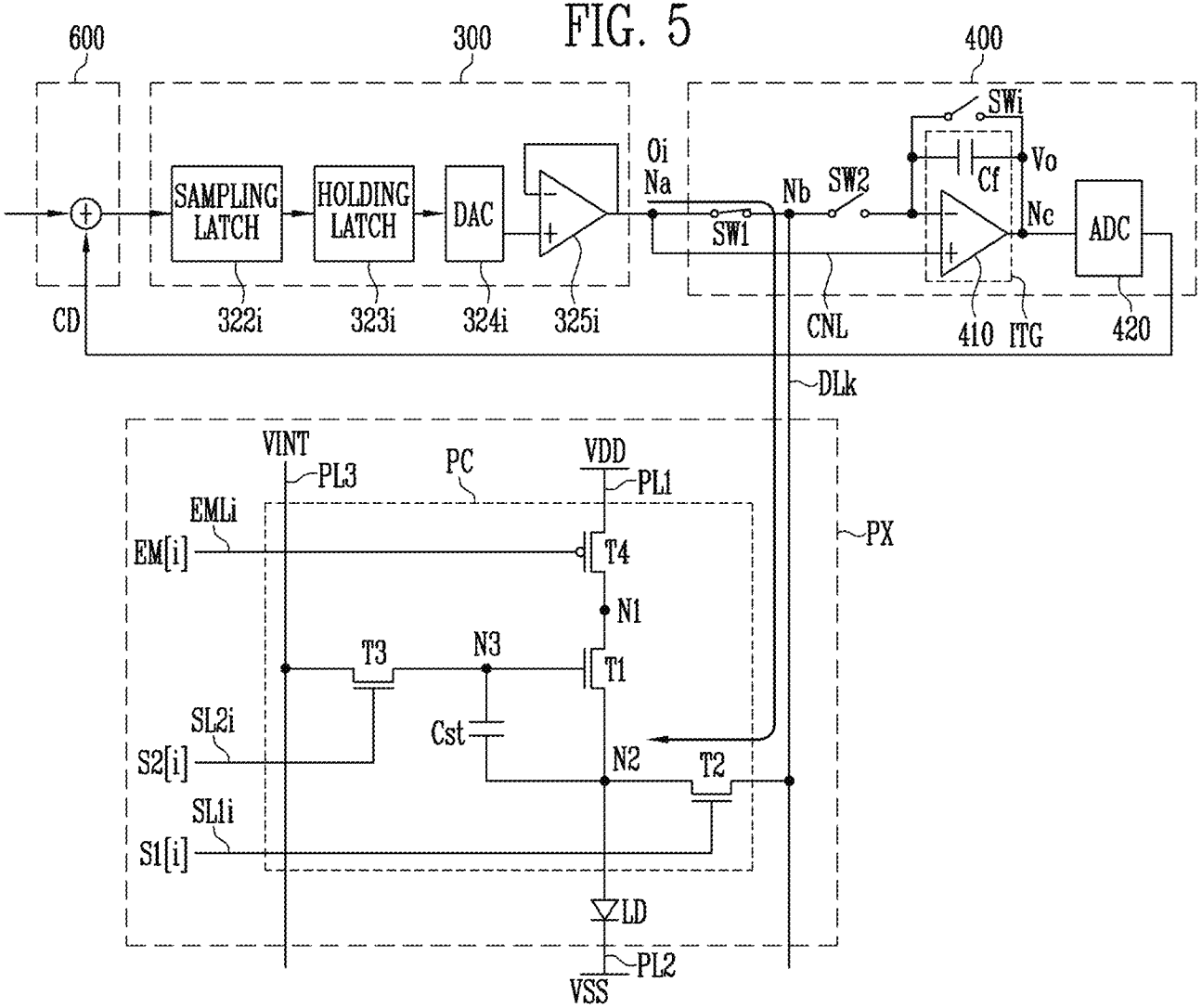
FIGS. 5 and 6 are diagrams illustrating an operation of the timing controller, the data driver, the sensing unit, and the pixel, which are shown in FIG. 1, during a sensing period.
Figure 6:
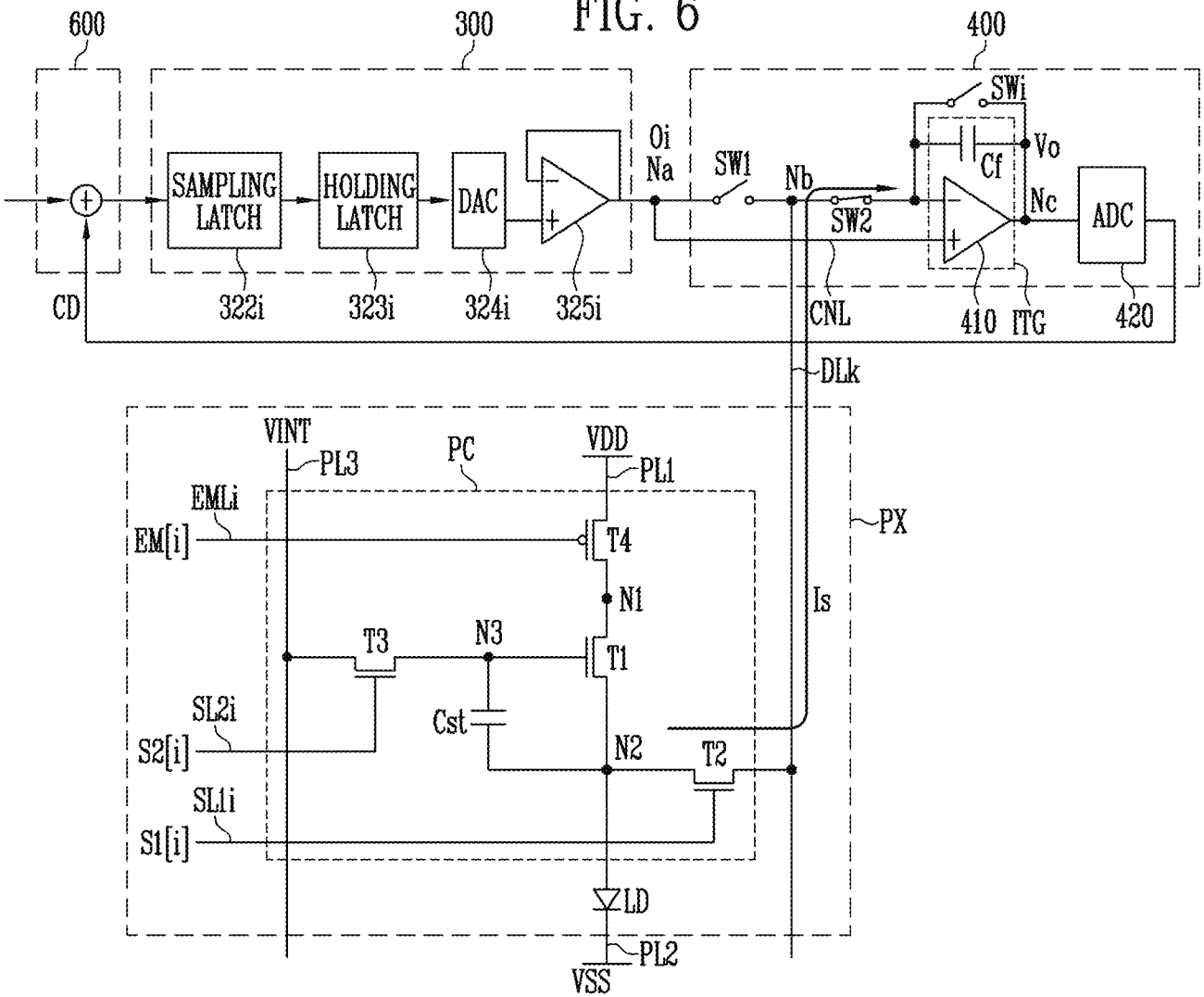
Figure 7:
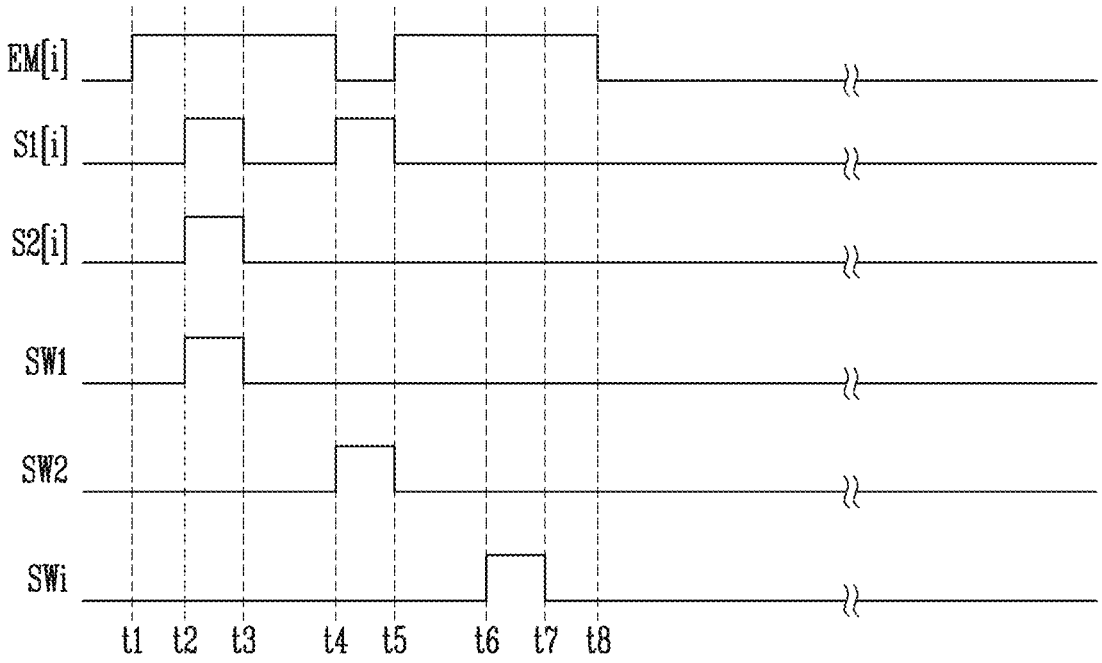
FIG. 7 is a timing diagram of control signals supplied to the timing controller, the data driver, the sensing unit, and the pixel, which are shown in FIG. 1, during the sensing period in accordance with an embodiment of the disclosure.
Figure 8:
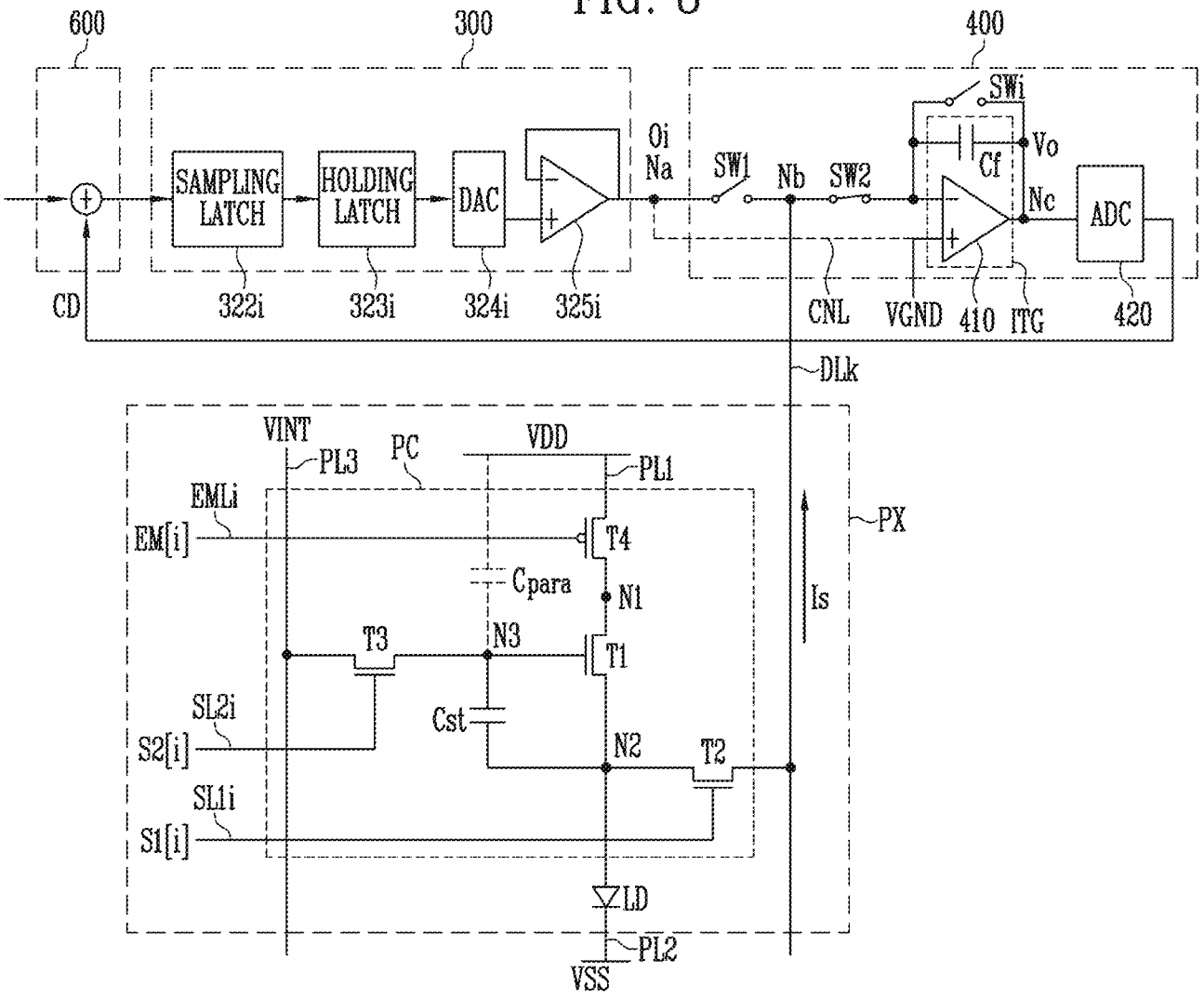
FIG. 8 is a diagram illustrating a coupling phenomenon occurring due to a parasitic capacitor.
Figure 9A:
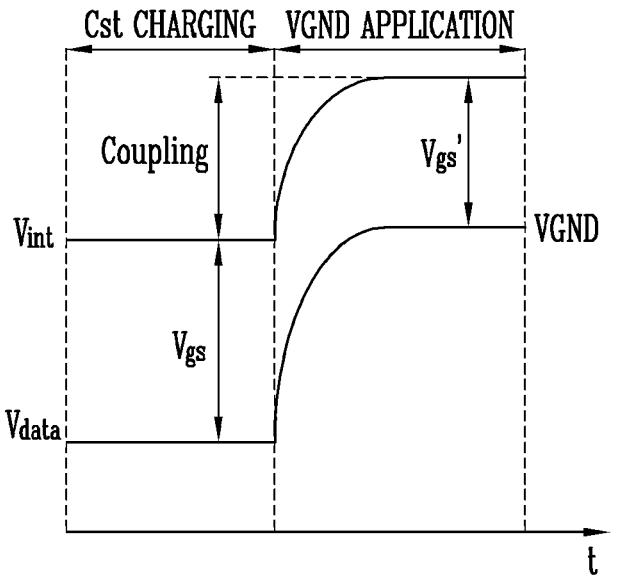
FIGS. 9A and 9B are graphs illustrating a capacitor coupling phenomenon occurring in a pixel in sensing and an effect thereof.
Figure 9B:
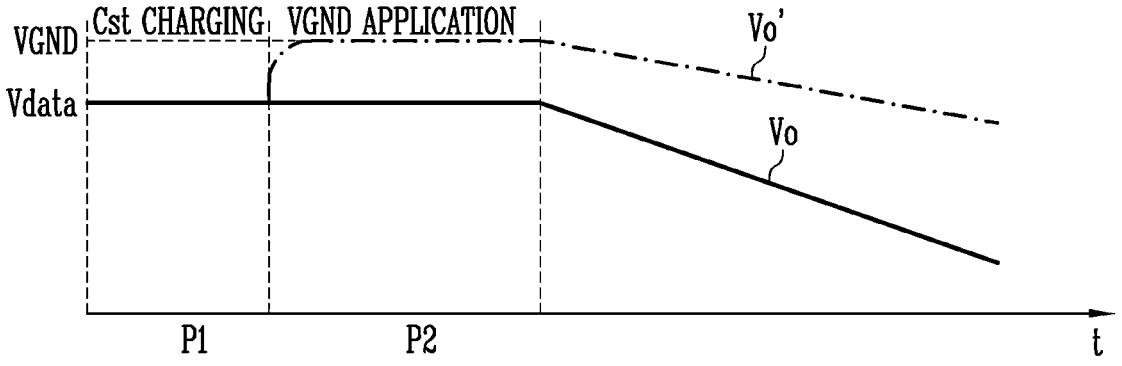

FIGS. 5 and 6 are diagrams illustrating an operation of the timing controller, the data driver, the sensing unit, and the pixel, which are shown in FIG. 1, during a sensing period. FIG. 7 is a timing diagram of control signals supplied to the timing controller, the data driver, the sensing unit, and the pixel, which are shown in FIG. 1, during the sensing period in accordance with an embodiment of the disclosure. FIG. 8 is a diagram illustrating a coupling phenomenon occurring due to a parasitic capacitor. FIGS. 9A and 9B are graphs illustrating a capacitor coupling phenomenon occurring in a pixel in sensing and an effect thereof.

Referring to FIGS. 1 and 5 to 7, during the sensing period, the pixel PX may be supplied with signals for sensing from the timing controller 600. The sensing period may include a period, in which a sensing reference voltage is supplied to the pixel PX from the data driver 300, and a period, in which a sensing voltage Vo corresponding to a sensing current Is is output by supplying the sensing current Is corresponding to the sensing reference voltage to the sensing unit 400 from the pixel PX.

In an embodiment, a turn-on level voltage of the first scan signal S1[*i*] and the second scan signal S2[*i*] may be defined as a logic high level voltage. In such an embodiment, a turn-on level voltage of the emission control signal EM[i] may be defined as a logic low level voltage. However, this is merely exemplary, and pulse widths and logic levels of the scan signals and the emission control signal are not limited thereto. The pulse widths and logic levels of the scan signals and the emission control signal may be variously modified to correspond to a pixel structure, a type of the transistors, etc.

In an embodiment, as shown in FIG. 7, during a period of a first time (or time point) t1 to a fourth time t4, the emission control signal EM[i] having a logic high level may be supplied to an emission control line EMLi. When the emission control signal EM[i] having the logic high level is supplied to the emission control line EMLi, the fourth transistor T4 may be turned off.

During a period between the second time t2 and the third time t3, the first scan signal S1[*i*] and the second scan signal S2[*i*] may be supplied, and the first switch SW1 may be turned on.

When the first switch SW1 is turned on, the data output line Oi and the data line DLk may be connected to each other.

The second transistor T2 may be turned on when the first scan signal S1[*i*] is supplied, and the third transistor T3 may be turned on when the second scan signal S2[*i*] is supplied. When the third transistor T3 is turned on, the third power source VINT and the third node N3 may be connected to each other. In such an embodiment, when the third transistor T3 is turned on, the gate electrode of the first transistor T1 may be initialized to the third power source VINT. In such an embodiment, when the second transistor T2 is turned on, the a-th node Na and the second node N2 may be connected to each other as shown in FIG. 5. Accordingly, the sensing reference voltage may be applied to a source electrode of the first transistor T1. The sensing reference voltage may be a voltage having a level lower than that of the third power source VINT. The storage capacitor Cst charges a voltage corresponding to the sensing reference voltage. In such an embodiment, the sensing reference voltage may be labeled with the reference character "Vdata" as the sensing reference voltage is the same as the data voltage Vdata output from the data driver 300.

During a period between the fourth time t4 and a fifth time t5, the emission control signal EM[i] having a logic low level and the first scan signal S1[*i*] having a logic high level may be supplied. Also, during the period between the fourth time t4 and the fifth time t5, the second switch SW2 may be turned on.

When the emission control signal EM[i] having the logic low level is supplied, the fourth transistor T4 may be turned on. Also, when the first scan signal S1[*i*] having the logic high level is supplied, the second transistor T2 may be turned on.

When the second switch SW2 and the second transistor T2 are turned on, a current path may be formed between the second node N2 and the first input terminal of the current integrator amplifier 410.

When the fourth transistor T4 is turned on, a current path may be formed between the first power source VDD and the second node N2 through the fourth transistor T4, which is connected to the first power source VDD, and the first transistor T1, which is connected to the second node N2. Then, the first transistor T1 may supply a current, i.e., the sensing current Is corresponding to the sensing reference voltage Vdata stored in the storage capacitor Cst, to the first input terminal of the current integrator amplifier 410 via the second node N2 from the first power source VDD, as shown in FIG. 6.

In an embodiment, during a period in which the sensing current Is is supplied to the current integrator amplifier 410, a second input terminal of the current integrator amplifier 410 may be connected to the a-th node Na through the connection line CNL. The sensing reference voltage Vdata may be supplied to the a-th node Na.

Hereinafter, a problem occurring in a case where the connection line CNL is not provided between the a-th node Na and the second input terminal of the current integrator amplifier 410 will be described with reference to FIGS. 8 and 9.

Referring to FIG. 8, in a case where the connection line CNL is not provided between the a-th node Na and the second input terminal of the current integrator amplifier 410, a parasitic capacitor Cpara may be formed to between the third node N3 and the first power source VDD in the pixel PX. Although a case where the parasitic capacitor Cpara is formed between the third node N3 and the first power source VDD is illustrated for convenience of description, the parasitic capacitor Cpara may be further formed between the third node N3 and the third power source VINT, between the third node N3 and the gate electrode of the third transistor T3, or the like.

In such a case, the storage capacitor Cst may be charged with a difference voltage Vgs (see FIG. 9A) between the voltage of the third power source VINT and the sensing reference voltage Vdata.

When a virtual ground voltage VGND is applied to the second input terminal of the current integrator amplifier 410 through a separate voltage source in sensing as shown in FIG. 8, a voltage of the second node N2 may be changed from the sensing reference voltage Vdata to the virtual ground voltage VGND.

When the voltage of the second node N2 is changed from the sensing reference voltage Vdata to the virtual ground voltage VGND, a coupling phenomenon may occur even in the storage capacitor Cst in a floating state. However, due to the parasitic capacitor Cpara formed at the third node N3, the voltage charged in the storage capacitor Cst may be changed to a voltage Vgs' (see FIG. 9A) different from the difference voltage Vgs of the voltage of the third power source VINT and the sensing reference voltage Vdata. Therefore, a sensing result different from a current characteristic of the pixel PX, which is to be originally measured, may be derived.

In such a case, referring to FIG. 9A, the sensing reference voltage Vdata may have a voltage level lower than that of the third power source VINT. In such a case, if the virtual ground voltage VGND is higher than the sensing reference voltage Vdata, the voltage Vgs' applied between both ends of the storage capacitor Cst by the parasitic capacitor Cpara may be lower than the difference voltage Vgs of the voltage of the third power source VINT and the sensing reference voltage Vdata. Therefore, the sensing current Is flowing in the current path formed between the second node N2 and the first input terminal of the current integrator amplifier 410 may be decreased, and hence the current integrator ITG may output a sensing voltage Vo' (see FIG. 9B) which does not correspond to the data signal applied thereto.

In such a case, if the virtual ground voltage VGND is lower than the sensing reference voltage Vdata, the voltage Vgs' applied between both the ends of the storage capacitor Cst by the parasitic capacitor Cpara may be higher than the difference voltage Vgs of the voltage of the third power source VINT and the sensing reference voltage Vdata. Therefore, the sensing current Is flowing in the current path formed between the second node N2 and the first input terminal of the current integrator amplifier 410 may be increased, and hence the current integrator ITG may output a sensing voltage (not shown) which does not correspond to the data signal applied thereto.

Referring to FIGS. 5 to 7 and 9B, in an embodiment of the disclosure, the a-th node Na and the current integrator amplifier 410 are connected to each other by the connection line CNL, such that the second input terminal of the current integrator amplifier 410 may receive the sensing reference voltage Vdata. Therefore, the voltage of the second node N2 may be effectively maintained as the sensing reference voltage Vdata between a first period P1 in which the sensing reference voltage Vdata is applied to the pixel PX from the data driver 300 and a second period P2 in which the sensing current Is corresponding to the sensing reference voltage Vdata is supplied to the sensing unit 400 from the pixel PX.

When the voltage of the second node N2 is maintained as the sensing reference voltage Vdata, the coupling phenomenon may not occur in the storage capacitor Cst. Therefore, the sensing current Is flowing in the current path between the second node N2 and the first input terminal of the current integrator amplifier 410 is effectively maintained before/after the sensing reference voltage is applied, and hence the current integrator ITG may accurately output a sensing voltage Vo corresponding to the data signal applied thereto. In such an embodiment, the sensing unit 400 may derive a sensing result which accords with the current characteristic of the pixel PX, which is to be originally measured.

As shown in FIG. 9B, in an embodiment of the disclosure, the voltage of the second node N2 is maintained as the sensing reference voltage Vdata in the first period P1 and the second period P2, an output voltage Vo of the current integrator amplifier 410 may be decreased with a first slope (see a solid line graph). In a case where the connection line CNL is not provided between the a-th node Na and the second input terminal of the current integrator amplifier 410, as shown in FIG. 8, when the virtual ground voltage VGND is higher than the sensing reference voltage Vdata, the sensing current Is flowing in the current path formed between the second node N2 and the first input terminal of the current integrator amplifier 410 is decreased, and hence an output voltage Vo' may be decreased with a second slope (see an alternate long and short dash line graph) smaller than the first slope. In such a case, due to the parasitic capacitor Cpara, the sensing unit 400 may output an inaccurate sensing voltage Vo' which does not correspond to the sensing reference voltage Vdata applied thereto.

Referring back to FIGS. 5 to 7, subsequently, the initialization switch SWi may be turned on during a period between a sixth time t6 and a seventh time t7. When the initialization switch SWi is turned on, the integrator capacitor Cf may be initialized.

Subsequently, during a display period, the timing controller 600 may supply, to the data driver 300, second data DATA2 obtained by adding the first data DATA1 and the compensation data CD, and the data driver 300 may supply a data signal corresponding to the second data DATA2 to the pixel PX. In such an embodiment, the display device 1000 may be supplied with a data signal obtained or compensated by considering degradation of the pixel PX. Thus, the display device 1000 may emit light with an accurate luminance in spite of the degradation of the pixel PX.

Hereinafter, alternative embodiments will be described. In such alternative embodiments, any repetitive detailed descriptions of the same or like components as those of the above-described embodiments will be omitted or simplified, and elements or features different from those of the above-described embodiments will be mainly described.

Figure 10:
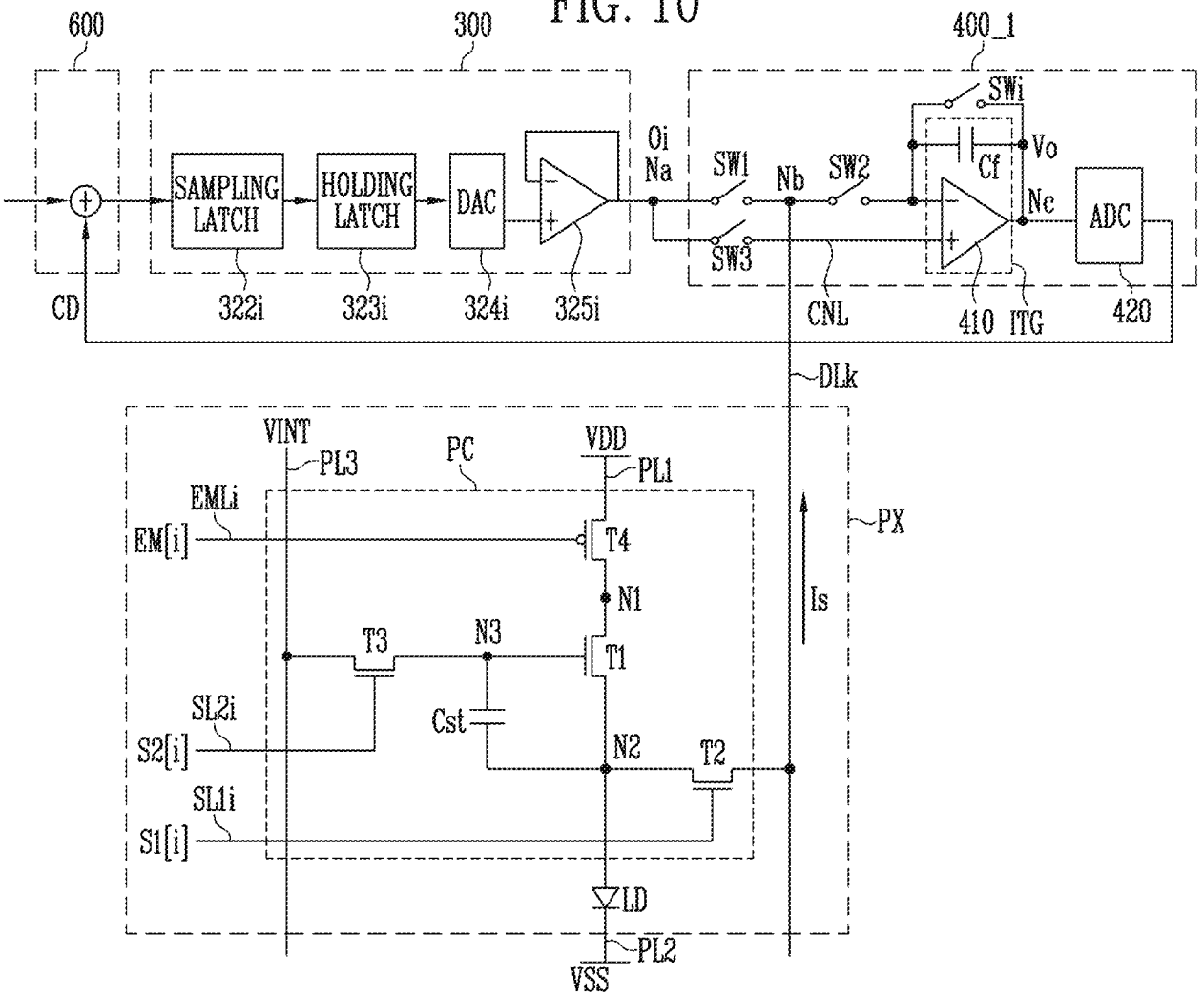
FIG. 10 is a diagram illustrating a connection structure of the timing controller, the data driver, the sensing unit, and the pixel, which are shown in FIG. 1, in accordance with an alternative embodiment of the disclosure.
Figure 11:
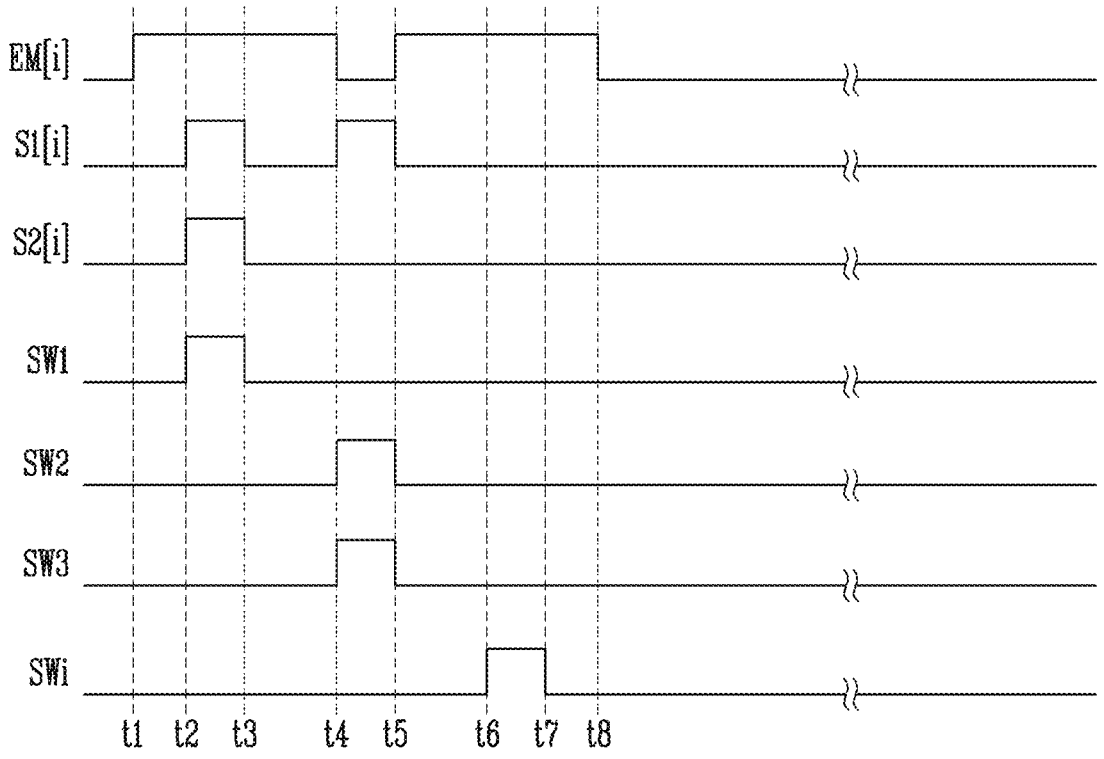
FIG. 11 is a timing diagram of the control signals supplied to the timing controller, the data driver, the sensing unit, and the pixel, which are shown in FIG. 1, during the sensing period in accordance with an alternative embodiment of the disclosure.

FIG. 10 is a diagram illustrating a connection structure of the timing controller, the data driver, the sensing unit, and the pixel, which are shown in FIG. 1, in accordance with an alternative embodiment of the disclosure. FIG. 11 is a timing diagram of the control signals supplied to the timing controller, the data driver, the sensing unit, and the pixel, which are shown in FIG. 1, during the sensing period in accordance with an alternative embodiment of the disclosure.

Referring to FIG. 10, a sensing unit 400_1 is substantially the same as that of the embodiment shown in FIG. 4, except that the sensing unit 400_1 further includes a third switch SW3, to allow the sensing reference voltage to be selectively supplied to the second input terminal of the current integrator amplifier 410.

In an embodiment, as shown in FIG. 10, the sensing unit 400_1 may include a first switch SW1, a second switch SW2, the third switch SW3, a current integrator ITG, an initialization switch SWi, and an ADC 420.

The first switch SW1, a second switch SW2, the current integrator ITG, and the initialization switch SWi are substantially the same as those shown in FIG. 4, and therefore, any repetitive detailed descriptions thereof will be omitted. Hereinafter, the third switch SW3 will be described in detail.

In such an embodiment, the third switch SW3 may be connected between the a-th node Na and the second input terminal of the current integrator amplifier 410. In such an embodiment, the third switch SW3 may be provided in the connection line CNL. The third switch SW3 may be turned on in response to a corresponding switching control signal output from the timing controller 600.

When the third switch SW3 is turned on, the second input terminal of the current integrator ITG may be connected directly to the a-th node Na through the connection line CNL. That is, the second input terminal of the current integrator ITG may receive the sensing reference voltage Vdata from the data driver 300 when the third switch SW3 is turned on, and stop the receiving of the sensing reference voltage Vdata from the data driver 300 when the third switch SW3 is turned off.

Referring to FIG. 11, during a period of a first time t1 to a fourth time t4, the emission control signal EM[i] having a logic high level may be supplied to the emission control line EMLi. When the emission control signal EM[i] having the logic high level is supplied to the emission control line EMLi, the fourth transistor T4 may be turned off.

During a period between the second time t2 and the third time t3, the first scan signal S1 [i] and the second scan signal S2[*i*] may be supplied, and the first switch SW1 may be turned on. When the first switch SW1 is turned on, the data output line Oi and the data line DLk may be connected to each other.

The second transistor T2 may be turned on when the first scan signal S1[*i*] is supplied, and the third transistor T3 may be turned on when the second scan signal S2[*i*] is supplied. When the third transistor T3 is turned on, the third power source VINT and the third node N3 may be connected to each other. Accordingly when the third transistor T3 is turned on, the gate electrode of the first transistor T1 may be initialized to the third power source VINT. In such an embodiment, when the second transistor T2 is turned on, the a-th node Na and the second node N2 may be connected to each other. That is, the sensing reference voltage Vdata may be applied to the source electrode of the first transistor T1. The sensing reference voltage Vdata may be a voltage having a level lower than that of the third power source VINT. The third switch S3 may maintain a turn-off state. That is, the sensing reference voltage Vdata may not be applied to the second input terminal of the current integrator amplifier 410.

During a period between the fourth time t4 and a fifth time t5, the emission control signal EM[i] having a logic low level and the first scan signal S1[*i*] having a logic high level may be supplied. Also, during the period between the fourth time t4 and the fifth time t5, the second switch SW2 and the third switch SW3 may be turned on. When the third switch SW3 is turned on, the a-th node Na and the second input terminal of the current integrator amplifier 410 may be connected to each other. The sensing reference voltage Vdata may be supplied to the a-th node Na.

When the emission control signal EM[i] having the logic low level is supplied, the fourth transistor T4 may be turned on. When the first scan signal S1[*i*] having the logic high level is supplied, the second transistor T2 may be turned on.

When the second switch SW2 and the second transistor T2 are turned on, a current path may be formed between the second node N2 and the first input terminal of the current integrator amplifier 410.

When the fourth transistor T4 is turned on, a current path may be formed between the first power source VDD and the second node N2 through the fourth transistor T4 and the first transistor T1. Then, the first transistor T1 may supply a current, i.e., a sensing current Is corresponding to the sensing reference voltage stored in the storage capacitor Cst to the first input terminal of the current integrator amplifier 410 via the second node N2 from the first power source VDD.

Subsequently, during a period between a sixth time t6 and a seventh time t7, the initialization switch SWi may be turned on. When the initialization switch SWi is turned on, the integrator capacitor Cf may be initialized.

Figure 12:
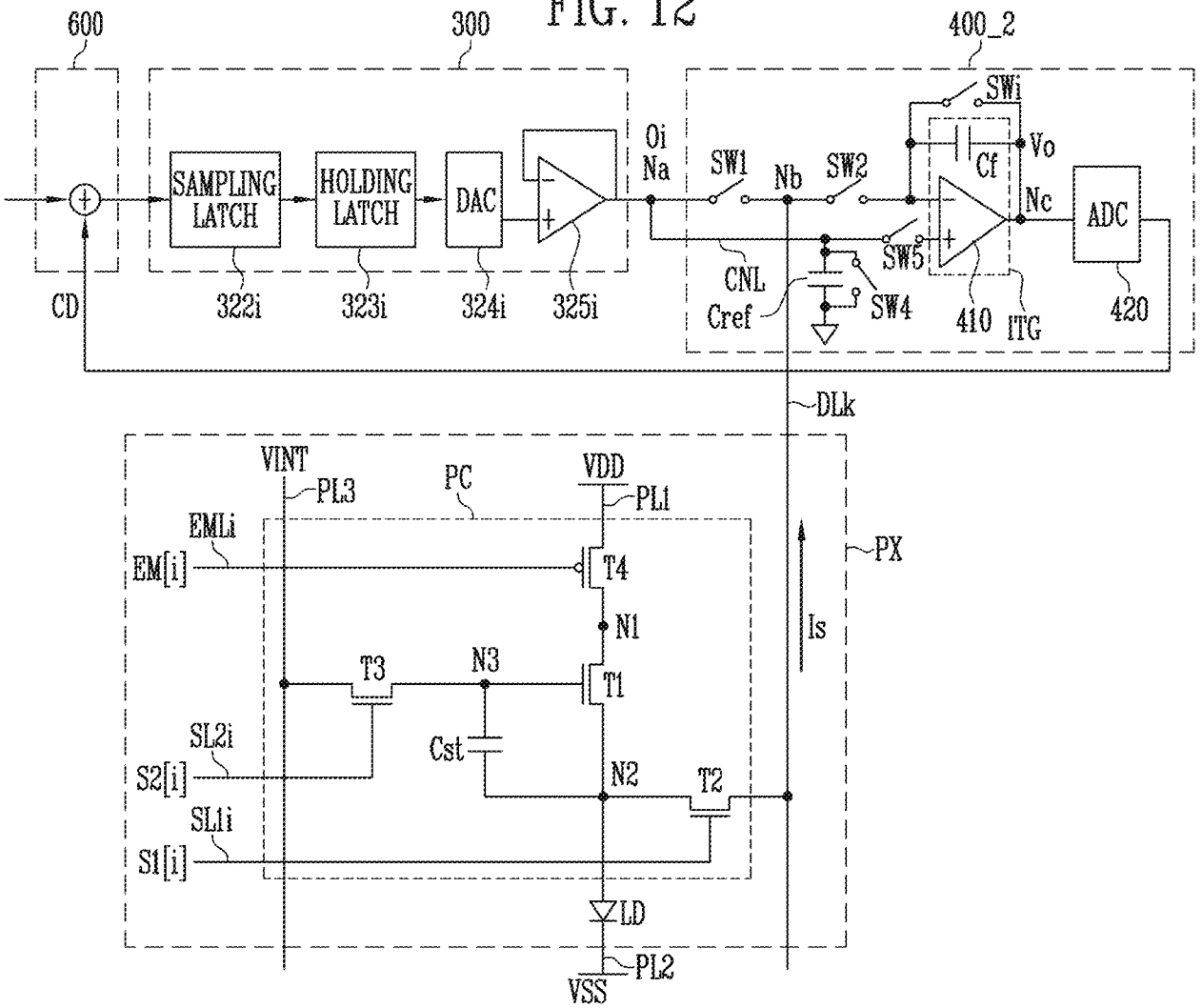
FIG. 12 is a diagram illustrating a connection structure of the timing controller, the data driver, the sensing unit, and the pixel, which are shown in FIG. 1, in accordance with another alternative embodiment of the disclosure.
Figure 13:
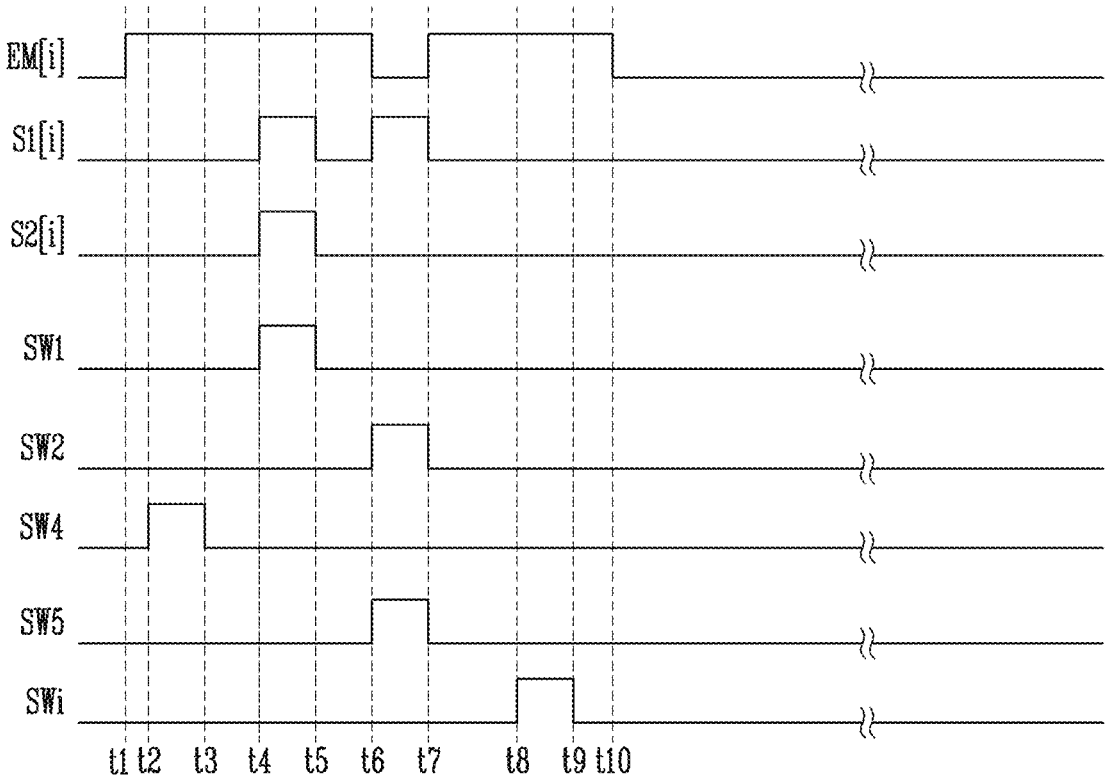
FIG. 13 is a timing diagram of the control signals supplied to the timing controller, the data driver, the sensing unit, and the pixel, which are shown in FIG. 1, during the sensing period in accordance with another alternative embodiment of the disclosure.

FIG. 12 is a diagram illustrating a connection structure of the timing controller, the data driver, the sensing unit, and the pixel, which are shown in FIG. 1, in accordance with another alternative embodiment of the disclosure. FIG. 13 is a timing diagram of the control signals supplied to the timing controller, the data driver, the sensing unit, and the pixel, which are shown in FIG. 1, during the sensing period in accordance with another alternative embodiment of the disclosure.

Referring to FIG. 12, in an embodiment, a sensing unit 400_2 may further include a fourth switch SW4, a fifth switch SW5, and a reference voltage storage capacitor Cref. In such an embodiment, the sensing unit 400_2 is substantially the same as that of the embodiment shown in FIG. 4, except that the sensing reference voltage may be supplied to the second input terminal of the current integrator amplifier 410 during only the sensing period.

In such an embodiment, as shown in FIG. 12, the sensing unit 400_2 may include a first switch SW1, a second switch SW2, the fourth switch SW4, the fifth switch SW5, a current integrator ITG, an initialization switch SWi, and an ADC 420.

The first switch SW1, the second switch SW2, the current integrator ITG, and the initialization switch SWi are substantially the same as those shown in FIG. 4, and therefore, any repetitive detailed descriptions thereof will be omitted. Hereinafter, the fourth switch SW4, the fifth switch SW5, and the reference voltage storage capacitor Cref will be described in detail.

In such an embodiment, the reference voltage storage capacitor Cref may be connected between the a-th node Na and a ground terminal. When the sensing reference voltage Vdata is supplied from the data driver 300, the sensing reference voltage Vdata may be applied between both ends of the reference voltage capacitor Cref.

The fourth switch SW4 may be connected in parallel to both the ends of the reference voltage storage capacitor Cref. When the fourth switch SW4 is turned on, the reference voltage storage capacitor Cref may be initialized. The fourth switch SW4 may be turned on in response to a corresponding switching control signal output from the timing controller 600.

The fifth switch SW5 may be connected between one end of the reference voltage storage capacitor Cref, which is connected to the a-th node Na, and the second input terminal of the current integrator amplifier 410. In other words, the fifth switch SW5 may be provided in one area of the connection line CNL. The fifth switch SW5 may be turned on in response to a corresponding switching control signal output from the timing controller 600.

Referring to FIG. 13, first, the emission control signal EM[i] having a logic high level may be supplied to the emission control line EMLi during a period of a first time t1 to a sixth time t6. When the emission control signal EM[i] having the logic high level is supplied to the emission control line EMLi, the fourth transistor T4 may be turned off.

During a period between the second time t2 and the third time t3, the fourth switch SW4 may be turned on. When the fourth switch SW4 is turned on, the reference voltage capacitor Cref may be initialized.

During a period between the fourth time t4 and the fifth time t5, the first scan signal S1 [i] and the second scan signal S2[*i*] may be supplied, and the first switch SW1 may be turned on. When the first switch SW1 is turned on, the data output line Oi and the data line DLk may be connected to each other.

The second transistor T2 may be turned on when the first scan signal S1[*i*] is supplied, and the third transistor T3 may be turned on when the second scan signal S2[*i*] is supplied. When the third transistor T3 is turned on, the third power source VINT and the third node N3 may be connected to each other. That is, when the third transistor T3 is turned on, the gate electrode of the first transistor T1 may be initialized to the third power source VINT. In addition, when the second transistor T2 is turned on, the a-th node Na and the second node N2 may be connected to each other. That is, when the sensing reference voltage Vdata may be applied to the source electrode of the first transistor T1. The sensing reference voltage Vdata may be a voltage having a level lower than that of the third power source VINT.

During a period between the sixth time t6 and a seventh time t7, the emission control signal EM[i] having a logic low level and the first scan signal S1[*i*] having a logic high level may be supplied. In addition, the second switch SW2 and the fifth switch SW5 may be turned on.

When the second switch SW2 is turned on, the second node N2 and the first input terminal of the current integrator amplifier 410 may be connected to each other.

When the emission control signal EM[i] having the logic low level is supplied, the fourth transistor T4 may be turned on. In addition, when the first scan signal S1[*i*] having the logic high level is supplied, the second transistor T2 may be turned on.

When the second switch SW2 and the second transistor T2 are turned on, a current path may be formed between the second node N2 and the first input terminal of the current integrator amplifier 410.

When the fourth transistor T4 is turned on, a current path may be formed between the first power source VDD and the second node N2 through the fourth transistor T4 and the first transistor T1. Then, the first transistor T1 may supply a current, i.e., a sensing current Is corresponding to the sensing reference voltage stored in the storage capacitor Cst to the first input terminal of the current integrator amplifier 410 via the second node N2 from the first power source VDD.

When the fifth switch SW5 is turned on, the a-th node Na and the second input terminal of the current integrator amplifier 410 may be connected to each other. That is, the sensing reference voltage Vdata stored in the reference voltage storage capacitor Cref may be applied to the second input terminal of the current integrator amplifier 410.

During a period between the seventh time t7 and a tenth time t10, the emission control signal EM[i] having the logic high level may be supplied to the emission control line EMLi. During a period between an eighth time t8 and a ninth time t9, the initialization switch SWi may be turned on. When the initialization switch SWi is turned on, the integrator capacitor Cf may be initialized.

Figure 14:
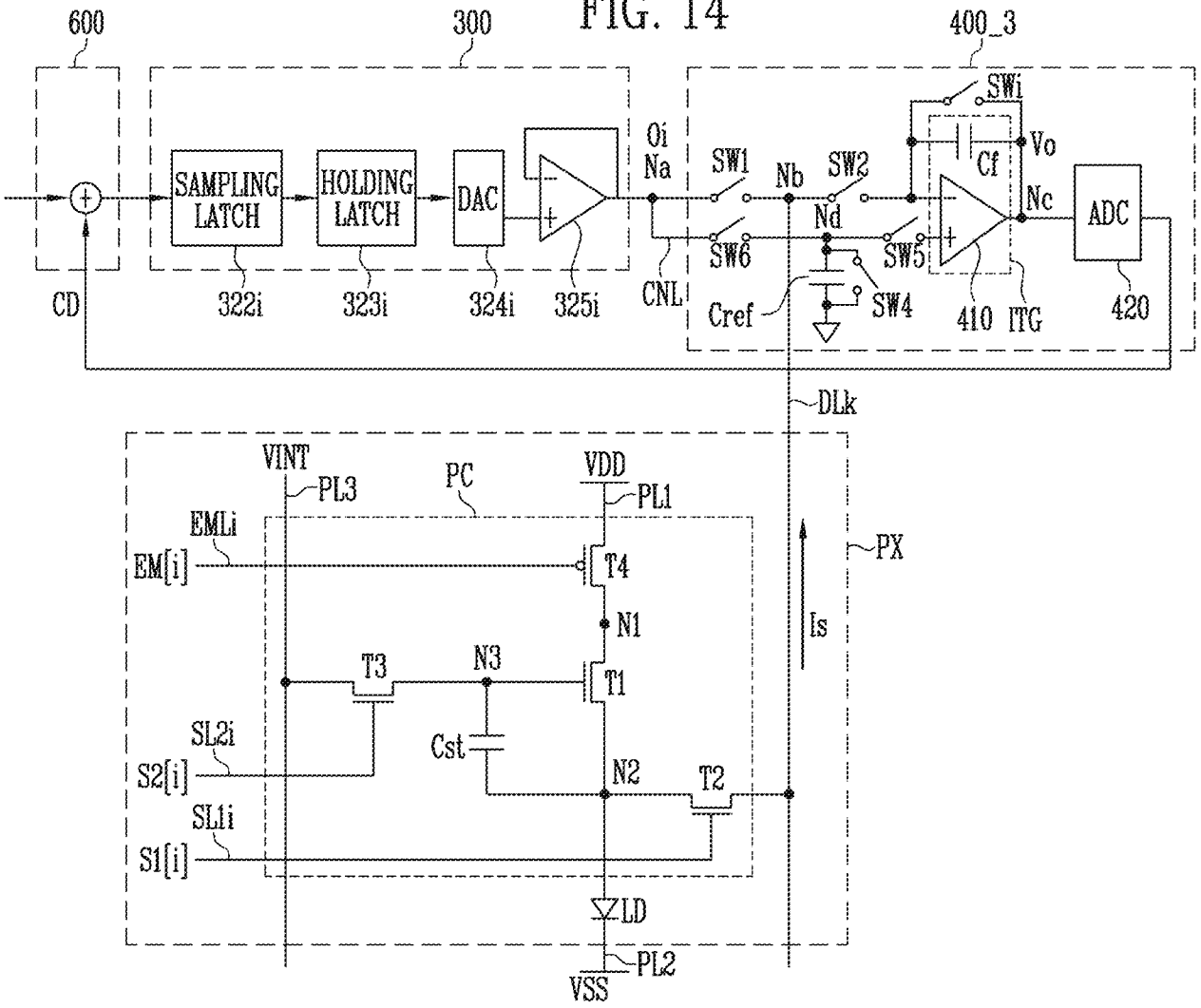
FIG. 14 is a diagram illustrating a connection structure of the timing to controller, the data driver, the sensing unit, and the pixel, which are shown in FIG. 1, in accordance with another alternative embodiment of the disclosure.
Figure 15:
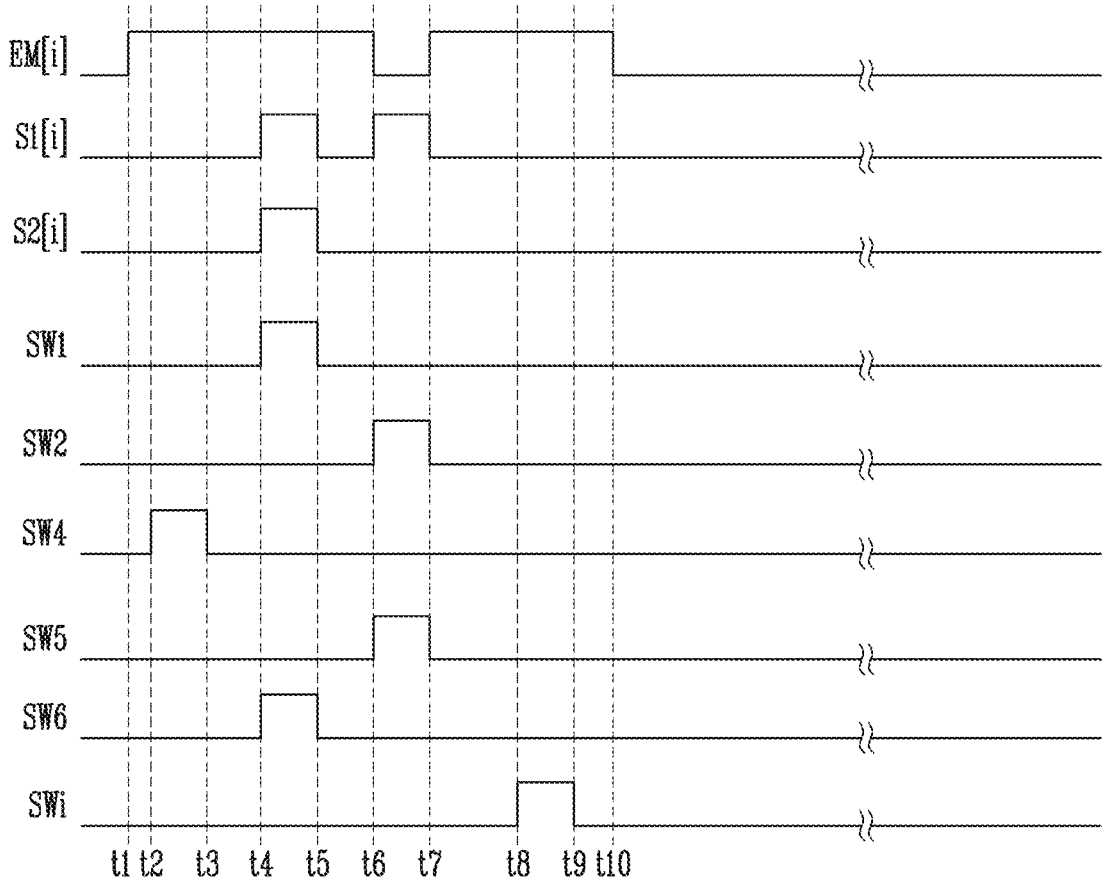
FIG. 15 is a timing diagram of the control signals supplied to the timing controller, the data driver, the sensing unit, and the pixel, which are shown in FIG. 1, during the sensing period in accordance with another alternative embodiment of the disclosure.

FIG. 14 is a diagram illustrating a connection structure of the timing controller, the data driver, the sensing unit, and the pixel, which are shown in FIG. 1, in accordance with another alternative embodiment of the disclosure. FIG. 15 is a timing diagram of the control signals supplied to the timing controller, the data driver, the sensing unit, and the pixel, which are shown in FIG. 1, during the sensing period in accordance with another alternative embodiment of the disclosure.

Referring to FIG. 14, a sensing unit 400_3 may further include a sixth switch SW6. In such an embodiment, the sensing unit 400_3 is substantially the same as that of the embodiment shown in FIG. 12, except that the supply of a data signal from the data driver 300 is blocked during the sensing period.

In such an embodiment, as shown in FIG. 14, the sensing unit 400_3 may include a first switch SW1, a second switch SW2, a fourth switch SW4, a fifth switch SW5, the sixth switch SW6, a current integrator ITG, an initialization switch SWi, and an ADC 420.

In such an embodiment, the first switch SW1, the second switch SW2, the fourth switch SW4, the fifth switch SW5, the current integrator ITG, and the initialization switch SWi are substantially the same as those shown in FIG. 12, and therefore, any repetitive detailed descriptions thereof will be omitted. Hereinafter, the sixth switch SW6 will be described in detail.

In such an embodiment, as shown in FIG. 14, the sixth switch SW6 may be connected between the a-th node Na and a d-th node Nd. In such an embodiment, the sixth switch SW6 may be provided in the connection line CNL. The sixth switch SW6 may be turned on in response to a corresponding switching control signal output from the timing controller 600.

Referring to FIG. 15, first, the emission control signal EM[i] having a logic high level may be supplied to the emission control line EMLi during a period of a first time t1 to a sixth time t6. When the emission control signal EM[i] having the logic high level may be supplied to the emission control line EMLi, the fourth transistor T4 may be turned off.

During a period between the second time t2 and the third time t3, the fourth switch SW4 may be turned on. When the fourth switch SW4 is turned on, the reference voltage capacitor Cref may be initialized.

During a period between the fourth time t4 and the fifth time t5, the first scan signal S1[*i*] and the second scan signal S2[*i*] may be supplied. Accordingly, the first switch SW1 and the sixth switch SW6 may be turned on.

When the first switch SW1 is turned on, the data output line Oi and the data line DLk may be connected to each other. When the sixth switch SW6 is turned on, the a-th node Na and the d-th node Nd may be connected to each other. Therefore, the sensing reference voltage Vdata supplied from the data driver 300 may be applied between both ends of the reference voltage storage capacitor Cref.

The second transistor T2 may be turned on when the first scan signal S1[*i*] is supplied, and the third transistor T3 may be turned on when the second scan signal S2[*i*] is supplied. When the third transistor T3 is turned on, the third power source VINT and the third node N3 may be connected to each other. That is, when the third transistor T3 is turned on, the gate electrode of the first transistor T1 may be initialized to the third power source VINT. In addition, when the second transistor T2 is turned on, the a-th node Na and the second node N2 may be connected to each other. That is, the sensing to reference voltage Vdata may be applied to the source electrode of the first transistor T1. The sensing reference voltage Vdata may be a voltage having a level lower than that of the third power source VINT.

During a period between the sixth time t6 and a seventh time, the emission control signal EM[i] having a logic low level and the first scan signal S1[*i*] having a logic high level may be supplied. During the period between the sixth time t6 and the seventh time, the second switch SW2 and the fifth switch SW5 may be turned on.

When the second switch SW2 is turned on, the second node N2 and the first input terminal of the current integrator amplifier 410 may be connected to each other.

When the emission control signal EM[i] having the logic low level is supplied, the fourth transistor T4 may be turned on. In addition, when first scan signal S1[*i*] having the logic high level is supplied, the second transistor T2 may be turned on.

When the second switch SW2 and the second transistor T2 are turned on, a current path may be formed between the second node N2 and the first input terminal of the current integrator amplifier 410.

When the fourth transistor T4 is turned on, a current path may be formed between the first power source VDD and the second node N2 through the fourth transistor T4 and the first transistor T1. Then, the first transistor T1 may supply a current, i.e., a sensing current Is corresponding to the sensing reference voltage stored in the storage capacitor Cst to the first input terminal of the current integrator amplifier 410 via the second node N2 from the first power source VDD.

When the fifth switch SW5 is turned on, the d-th node Nd and the second input terminal of the current integrator amplifier 410. That is, the sensing reference voltage Vdata stored in the reference voltage storage capacitor Cref may be applied to the second input terminal of the current integrator amplifier 410.

During a period between the seventh time t7 and a tenth time t10, the emission control signal EM[i] having the logic high level may be supplied to the emission control line EMLi. During a period between an eighth time t8 and a ninth time t9, the initialization switch SWi may be turned on. When the initialization switch SWi is turned on, the integrator capacitor Cf may be initialized.

In accordance with embodiments of the disclosure, the display device reduces the capacitor coupling phenomenon occurring in the pixel unit in sensing, such that accurate sensing voltage corresponding to a data signal may be output.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

a pixel unit comprising a pixel connected to a data line;

a data driver which supplies a sensing reference voltage to the data line during a sensing period, and supplies a data signal to the data line during a display period; and a sensing unit which receives a sensing current corresponding to the sensing reference voltage during the sensing period, and generates correction data based on the sensing current, wherein the sensing unit comprises a current integrator which outputs a sensing voltage based on the sensing current input thereto through a first input terminal and based on the sensing reference voltage input thereto through a second input terminal, wherein the second input terminal of the current integrator amplifier is connected to an a-th node connected to an output terminal of a buffer of the data driver through a connection line.

2. The display device of claim 1, wherein the current integrator comprises:

a current integrator amplifier including the first input terminal and the second input terminal; and an integrator capacitor including one end connected to the first input terminal and another end connected to an output terminal of the current integrator amplifier.

3. The display device of claim 2, the sensing unit further comprises:

an initialization switch including one end connected to the first input terminal and another end connected to the output terminal of the current integrator amplifier.

4. The display device of claim 2, wherein the buffer comprises buffer amplifiers which supply the sensing reference voltage or the data signal to data output lines.

5. The display device of 4, wherein a b-th node connected to the data line is connected between the a-th node and the first input terminal of the current integrator amplifier, and the sensing unit further comprises a first switch connected between the a-th node and the b-th node, and a second switch connected between the b-th node and the first input terminal of the current integrator amplifier.

6. The display device of claim 5, wherein the first switch is turned on while the sensing reference voltage is being supplied to the pixel, and the second switch is turned on while the sensing current is being supplied to the sensing unit.

7. The display device of claim 5, wherein the connection line includes a third switch connected between the a-th node and the second input terminal of the current integrator amplifier, and the third switch is turned on while the sensing current is being supplied to the sensing unit.

8. The display device of claim 4, wherein the connection line further includes a reference voltage storage capacitor connected between the a-th node and a ground terminal.

9. The display device of claim 8, wherein the sensing unit further comprises:

a fourth switch including one end connected to the a-th node and another end connected to the ground terminal; and a fifth switch connected between one end of the reference voltage storage capacitor, which is connected to the a-th node, and the second input terminal of the current integrator amplifier.

10. The display device of claim 9, wherein the fourth switch is turned on in a certain period before the data signal is supplied to the pixel, and the fifth switch is turned on while the sensing current is being supplied to the sensing unit.

11. The display device of claim 9, the sensing unit further comprises:

a sixth switch connected between the a-th node and the one end of the reference voltage storage capacitor, which is connected to the connection line.

12. The display device of claim 11, wherein the sixth switch is turned on while the data signal is being supplied to the pixel.

13. The display device of claim 1, wherein the sensing unit generates compensation data including degradation information of the pixel, based on the sensing voltage.

14. The display device of claim 13, wherein the sensing unit further comprises:

a timing controller which receives first image data from the outside, and supplies, to the data driver, second image data obtained by adding the first image data and the compensation data.

15. The display device of claim 14, wherein the sensing unit further comprises:

an analog-digital converter connected between an output terminal of a current integrator amplifier of the current integrator and the timing controller, wherein the analog-digital converter converts the sensing voltage from an analog form to a digital form.

16. The display device of claim 1, wherein the pixel is connected to a first scan line, a second scan line, and an emission control line, wherein the pixel comprises:

a light emitting diode connected to a second power source;

a first transistor including a first electrode connected to a first node electrically connected to a first power source, a second electrode connected to a second node, which is connected to the light emitting diode, and a gate electrode connected to a third node;

a second transistor connected between the data line and the second node, wherein a gate electrode of the second transistor is connected to the first scan line; and a third transistor connected between the third node and a third power source, wherein a gate electrode of the third transistor is connected to the second scan line.

17. The display device of claim 16, wherein the pixel further comprises a fourth transistor connected between the first power source and the first node, wherein a gate electrode of the fourth transistor is connected to the emission control line.

18. The display device of claim 17, wherein the pixel further comprises a storage capacitor connected between the second node and the third node.

19. The display device of claim 17, wherein the second transistor and the third transistor are turned on while the sensing reference voltage or the data signal is being supplied to the pixel.

20. The display device of claim 19, wherein the second transistor and the fourth transistor are turned on while the sensing current is being supplied to the sensing unit.

21. The display device of claim 16, wherein the pixel further comprises a storage capacitor connected between the second node and the third node.

22. The display device of claim 16, wherein the second transistor and the third transistor are turned on while the sensing reference voltage or the data signal is being supplied to the pixel.

* * * * *